US006315587B1

(12) United States Patent
Ikemoto et al.

(10) Patent No.: US 6,315,587 B1
(45) Date of Patent: Nov. 13, 2001

(54) CARD CONNECTOR

(75) Inventors: Shinichi Ikemoto; Tomoyuki Mogami, both of Tokyo (JP)

(73) Assignee: Kel Corporation, Tokyo (JP)

( * ) Notice: Subject to any disclaimer, the term of this patent is extended or adjusted under 35 U.S.C. 154(b) by 0 days.

(21) Appl. No.: 09/814,156

(22) Filed: Mar. 21, 2001

(30) Foreign Application Priority Data

Apr. 20, 2000 (JP) ..... 12-118977
Jul. 14, 2000 (JP) ..... 12-213699

(51) Int. Cl.[7] ..... H01R 13/62
(52) U.S. Cl. ..... 439/159; 439/953; 361/726
(58) Field of Search ..... 439/159, 630, 439/953, 188, 297; 361/683, 726, 685, 724, 684, 725, 747

(56) References Cited

U.S. PATENT DOCUMENTS 4,749,164 * 6/1988 Leo et al. ..... 248/674
5,122,914 * 6/1992 Hanson ..... 360/98.01
5,495,391 * 2/1996 Kirk ..... 361/684
5,587,854 * 12/1996 Sato et al. ..... 360/97.01
5,923,541 * 7/1999 Yasumi ..... 361/798
6,129,571 10/2000 Ikemoto ..... 439/260
6,137,684 * 10/2000 Ayd et al. ..... 361/727

* cited by examiner

*Primary Examiner*—Tulsidas Patel
(74) *Attorney, Agent, or Firm*—Robert W. J. Usher

(57) ABSTRACT

A connector element 5 removably holding a card 2 containing stored data is mounted within a case 100 such that the connector element is slidable in the card 2 insert/eject direction, this connector element 5 being normally urged in the card 2 eject direction by springs SP1, SP2. A connector element mounting member 120 is provided with a locked portion 125 detained by a locking member 143 urged rightward by a spring 142 when the connector element 5 has been slid in the card 2 insert direction, and the locking member 143 is unlocked by leftward motion thereof by means of magnetic attraction by a solenoid 140 operated by a switch 147.

11 Claims, 22 Drawing Sheets

145
131
125
120
13
5
2

CARD CONNECTOR

FIELD OF THE INVENTION

The present invention relates to a card connector for receiving and holding a card containing stored data, so as to allow data to be transmitted to and from the card.

BACKGROUND OF THE INVENTION

One such card of this kind has planar contacts formed on its surface so that when the card is inserted into the connector, planar contacts on the card come into contact with terminals provided to the connector, allowing data to be transmitted to and from the card via the card connector. Conventional card connectors used for connecting cards of this type are designed such that the card is inserted fully inserted into the connector so as to prevent the inserted card from inadvertently coming out from the connector during data transmission, or prevent accidental removal thereof by the hand. However, this makes it difficult to remove the card once data transmission has been completed. For this reason, some connectors are equipped with an ejection mechanism for ejecting the card from the connector, allowing it to be removed.

Card connectors of this kind are typically designed so that with a card inserted, contacts provided to the connector come into contact with planar contacts on the card to create electrical connection; during this time, the card is held in place pinched by the connector contacts. This arrangement necessitates that the ejection mechanism can generate force sufficient to push out the card in opposition to the pinching force exerted by the connector contacts, creating the problem of a need for a larger ejection mechanism. Existing ejection mechanisms include those employing spring force to push out (or pull out) the card, and those in which the card is transported by means of an electric motor or the like, but such arrangements necessitate strong spring force or require a rather large motor to provide the needed rotary driving force. Thus, each has the drawback of contributing to larger size of the device.

SUMMARY OF THE INVENTION

It is an object of the present invention to provide a card connector that, while designed to prevent an inserted card from inadvertently coming out so as to ensure successful data transmission, can be provided in a compact device.

The card connector herein comprises a connector element for removably holding a card containing stored data so as to allow data to be transmitted to and from said card; and a case for supporting said connector element so as to enable sliding thereof in said card insert/eject direction; wherein said card is inserted into or removed from said connector element with said connector element situated at a card insert/eject position to which said connector element has slid from said case in the eject direction; and wherein data transmission is carried out with said card received and held by said connector element situated at card service position to which said connector element has slid into said case in the insert direction.

In a card connector of this design, the connector element is not fixed to the case but is rather supported thereby so as to enable sliding thereof in the card insert/eject direction; when a card is to be inserted, the connector element situated at the card insert/eject position is moved in the card insert direction to a card service position by means of the force of inserting the card therein. Once reaching the card service position, data transmission to and from the card received and held by the connector element is performed via the card connector. In this way, the card is accommodated at a card service position situated fully inserted into the case during data transmission to and from the card, thus preventing inadvertent card insertion/ejection or coming out during data transmission. To eject the card, the connector element is extended outwardly to the card insert/eject position, allowing the card to be removed easily by picking the outwardly extended card with the hand.

In conventional arrangements that rely on an urging member to push out (or pull out) the card in order to eject it, the urging member must be able to produce urging force adequate to push out (or pull out) the card in opposition to the pinching force exerted on the card by the contacts. With the connector element herein, however, the card, held in the connector element, is extended outwardly by sliding the connector element to the card insert/eject position, and since little force is required to slide the card extended outward, the card ejection mechanism can be made more compact.

In a card connector of the above arrangement, the connector element may comprise an urging member for normally urging the connector element in the direction of card ejection (e.g., springs SP1, SP2 described in the embodiments); locking means for locking the connector element at the card service position (e.g., locking member 143 and locked portion 125 formed in the connector element mounting member 120 described in the embodiments); and unlocking means for unlocking the locking means (e.g., the solenoid 140 described in the embodiments).

In a card connector of this design, the connector element is not fixed to the case but is rather supported thereby so as enable sliding thereof in the card insert/eject direction, and is furthermore normally urged in the card eject direction by an urging member, whereby the connector element per se may be pushed in the insert direction by the card insertion force created during insertion of the card, and then locked in place at the card service position by locking means. Thus the card may be accommodated fully inserted into the case, preventing the card from inadvertently coming out during data transmission so as to assure successful data transmission. When ejecting the card, the lock is unlocked by unlocking means, and the connector element per se moves in the card eject direction to the card insert/eject position under the urging force of the urging member, preventing difficulty in ejecting the card and avoiding impediments to the operation of ejecting the card.

In conventional arrangements that rely on an urging member to push out (or pull out) the card in order to eject it, the urging member must be able to produce urging force adequate to push out (or pull out) the card in opposition to the pinching force exerted on the card by the contacts. The urging member herein, however, need only produce force sufficient to move the connector element in the card eject direction, and as such can be made smaller in size, making the device more lightweight and compact overall. With this mechanism, card ejection is accomplished by the recovery force of the urging member once the lock has been unlocked, and thus, in contrast to mechanisms in which the card is forcibly pushed out in the eject direction, there is no risk of damage to the eject mechanism in the event that the card should be mistakenly pushed in the insert direction during a card eject operation. Safer operation is afforded thereby.

In preferred practice, the urging member herein will consist of a compression or extension helical spring extending in the card insert/eject direction and linking the case with the connector element. With this arrangement, the urging member can be situated on the case exterior, allowing the space within the case to be made smaller. Alternatively, the urging member may consist of a helical torsion spring arranged extending between the case inner wall and the end of the connector element proximate to the case wall when moving in the card insert direction. With this arrangement, the urging member can be housed compactly within the case, making it useful in cases where the urging means cannot be situated outside the case and must be situated inside the case.

In preferred practice, the locking means will be designed so that a detaining member provided to the case (e.g., locking member 143 in the embodiments) and a detained member provided to the connector element (e.g., the connector element mounting member 120 in the embodiments, and particularly the locked portion 125 formed on this member 120) can interlock to lock the connector element in predetermined position, and the unlocking means will be designed to electrically move the detaining member in the unlocking direction to effect unlocking. Alternatively, the locking means may be designed so that a detained member provided to the connector element is detained by a detaining member provided to the case to effect locking in predetermined position, and the unlocking means designed so that unlocking is affected by moving the detaining member manually. With this arrangement, the connector element may be locked into predetermined position and unlocked by means of a simple mechanism. Typically, in mechanisms having manual unlocking function, an unlock control element is provided at the card insertion opening, this control element being pushed in the card insert direction during an eject operation. This poses the risk that that the card may be pushed in the insert direction during a card ejection operation. As noted, according to the present invention, card ejection is accomplished by means of the recovery force of the urging means, obviating the risk of damage even where a manual card eject mechanism is employed. Worry-free operation is provided thereby.

In another embodiment, the card connector herein comprises a connector element for removably holding a card containing stored data so as to allow data to be transmitted to and from this card; a case for supporting the connector element so as to allow it to slide in the card insert/eject direction; an electric motor; and a connector element transport mechanism, driven by the electric motor, for sliding the connector element in the card insert/eject direction (e.g., rack 328 and pinion 342 described in the embodiments).

In a card connector of this design, the connector element is not fixed to the case but is rather supported thereby so as to enable sliding thereof in the card insert/eject direction, the connector element being moveable in the card insert/eject direction under the power of an electric motor, whereby the connector element per se can be moved in the card insertion direction in response to insertion of a card, and then held at the card service position. In this way, the card is accommodated fully inserted into the case, thus preventing the card from inadvertently coming out during data transmission. During card ejection, the connector element, under the power of the electric motor, moves in the card eject direction to the card insert/eject position, preventing difficulty in ejecting the card and avoiding impediments to the operation of ejecting the card.

In conventional arrangements that rely on roller members or the like driven by an electric motor to insert/eject the card, the electric motor must be able to produce force adequate to transport the card in opposition to the pinching force exerted on the card by the contacts. The electric motor herein, however, need only produce force sufficient to move the connector element in the card eject direction, and as such can be made smaller in size, making the device more lightweight and compact overall. The electric motor can be made smaller in size, reducing its energy consumption and reducing operating costs.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein:

FIG. 16E depicting the connector element, with the card held in the receiving space thereof, slid forward within the case, respectively;

DESCRIPTION OF THE PREFERRED EMBODIMENTS

Figure 1:
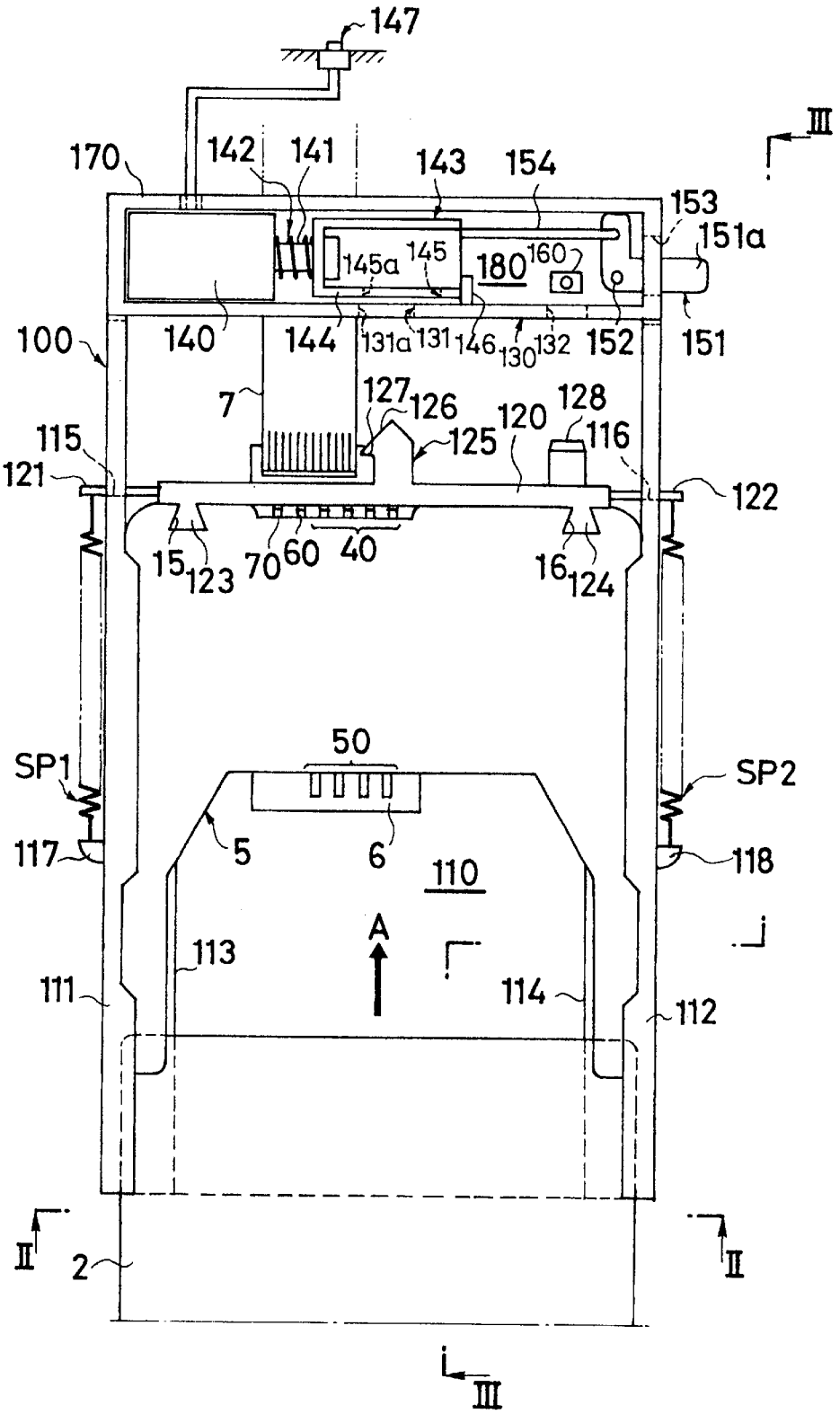
FIG. 1 is a plan view of a card connector pertaining to a first embodiment of the invention.
Figure 2:
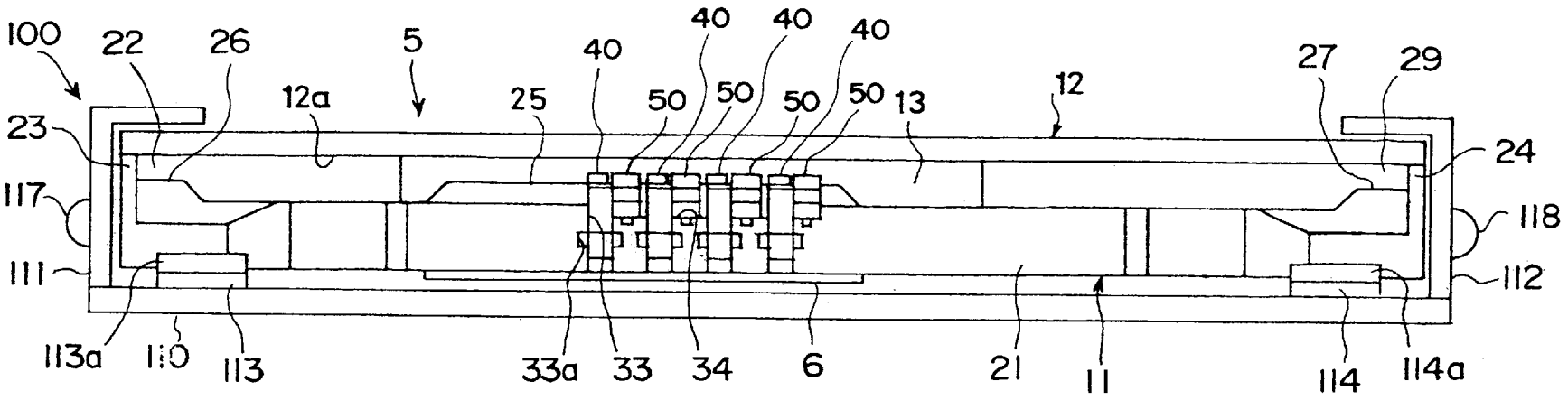
FIG. 2 is a front view of the card connector taken along line II—II in FIG. 1.
Figure 3:
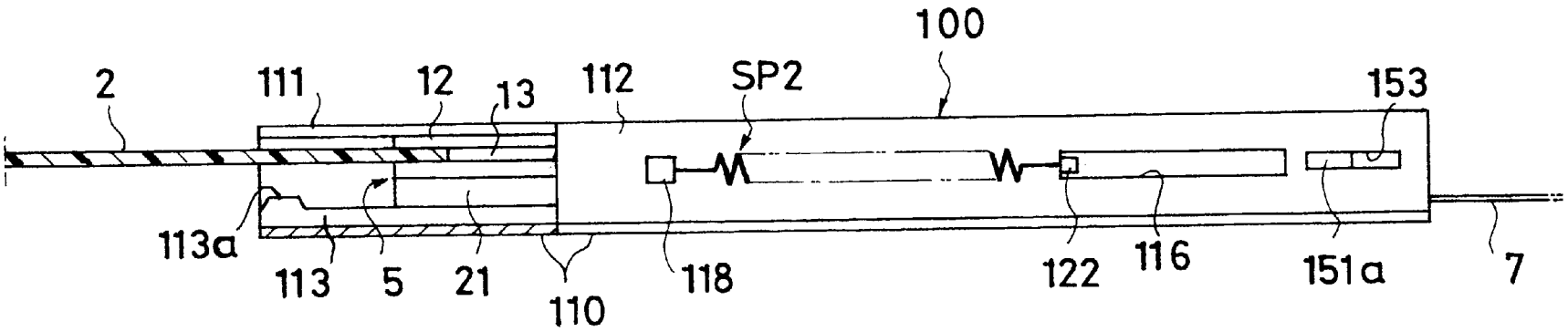
FIG. 3 is a partly sectional side view of the card connector taken along line III—III in FIG. 1.
Figure 4:
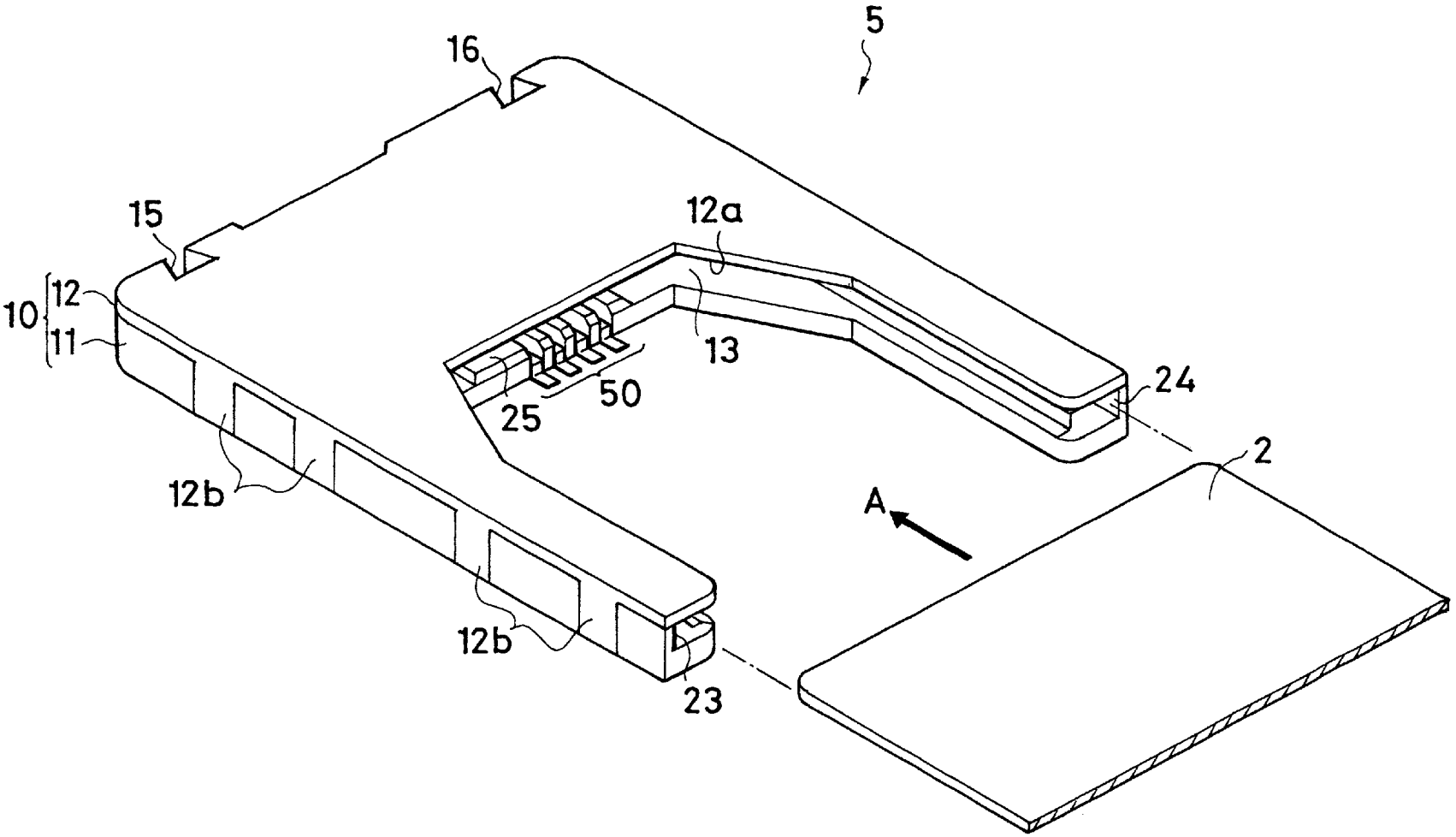
FIG. 4 is a perspective view of a connector element and a card.

The preferred embodiments of the invention are described hereinbelow with reference to the accompanying drawings. A first embodiment of the card connector pertaining to the first invention is depicted in FIGS. 1 to 3. FIG. 1 is a plan view of the card connector; FIG. 2 is a front view of the card connector taken along line II—II in FIG. 1; and FIG. 3 is a side view of the card connector taken along line III—III in FIG. 1 (the view taken along line III—III is shown rotated 90° clockwise). The card connector comprises a connector element 5, installed in a case 100, removably holding therein a card 2 containing stored data, for data transmission to and from card 2. FIG. 4 shows the connector element 5, removed from the card connector, together with a card 2. Card 2 has embedded therein an IC chip containing stored data, the back face of card 2 being provided with planar contacts connected with this IC chip. For convenience, in the following description the card 2 insert/eject direction (indicated by arrow A in FIGS. 1 and 4) shall be defined as the "anteroposterior direction" of the card connector and the direction of widthwise extension of card 2 as the "sideways direction." The direction of card 2 insertion (direction indicated by arrow A) is designated as the "rearward direction."

Figure 5:
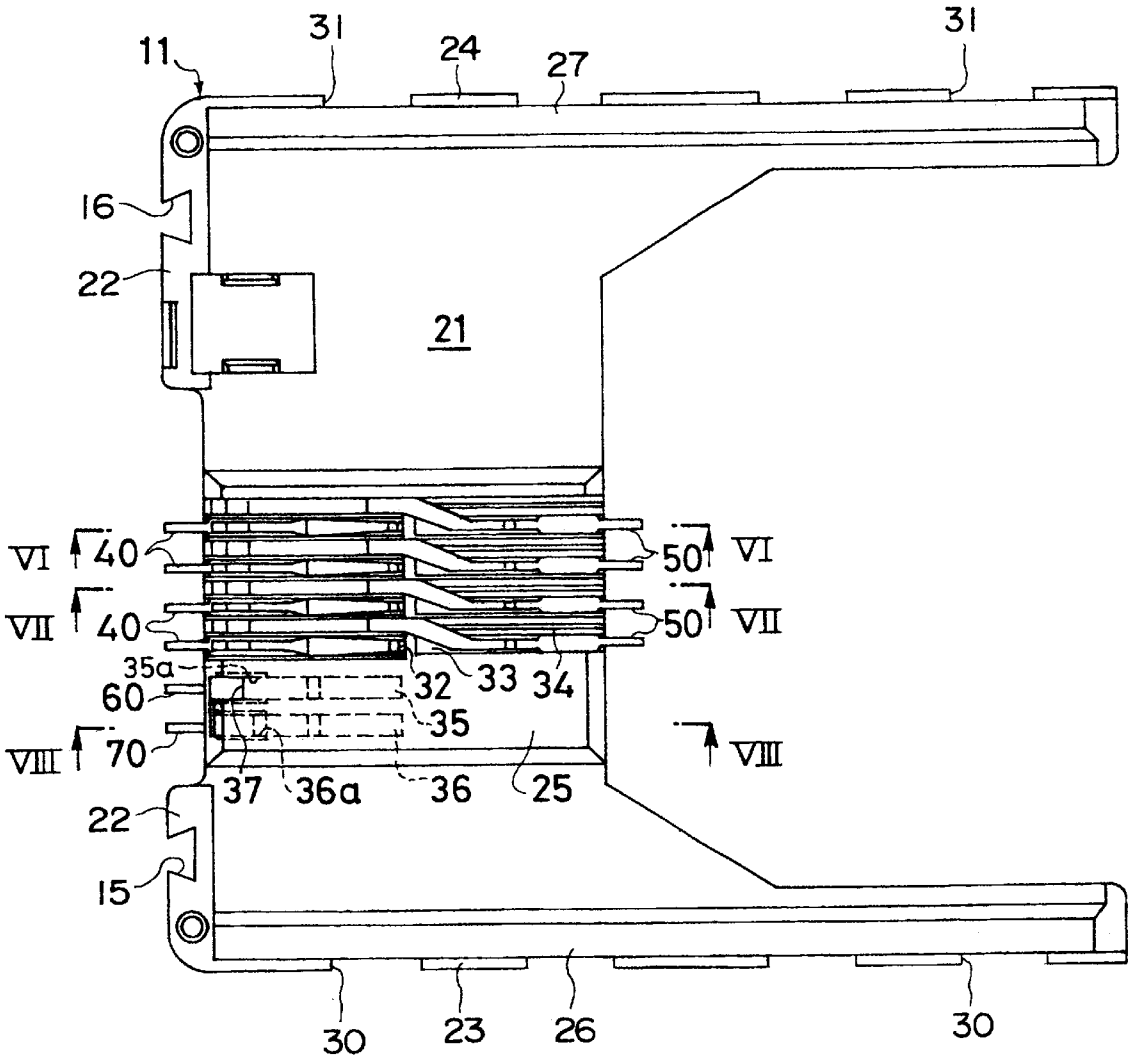
FIG. 5 is a plan of a connector element with the cover member removed.

As shown in FIG. 4, the housing 10 of connector element 5 comprises a chassis member 11 and a cover member 12 removably attached thereon. First and second contacts 40, 50 (there being a plurality of each) and first and second switch members 60, 70 are arranged on the chassis member 11 (see FIGS. 1 and 5). The chassis member 11 of housing 10 has a bottom wall 21, a rear wall 22 extending upward from the rear edge of bottom wall 21, and left and right side walls 23, 24 extending upward from the left and right edges of bottom wall 21, as shown in FIG. 5. The bottom wall 21, rear wall 22, left and right side walls 23, 24, and cover member 12 together define a receiving space 13 for the card 2 (however, there is an opening in the center of rear wall 22), card 2 being inserted into this receiving space 13 through an open portion at the front thereof.

As shown in FIG. 2, a center stage portion 25 and left and right side stage portions 26, 27 are formed in the approximate center and left and right sides (to the inside of side walls 23, 24) of bottom wall 21, these stages projecting upward to terminate in upper faces situated a predetermined distance away from the bottom face 12*a* of cover member 12. Card 2 is inserted between the bottom face 12*a* of cover member 12 and the center stage portion 25 and left and right side stage portions 26, 27 located within receiving space 13; the top faces of side stage portions 26, 27 and the bottom face 12*a* of cover member 12 define guide slots 28, 29 for smooth insertion of card 2. As shown in FIG. 5, left and right side walls 23, 24 of chassis member 11 of housing 10 are each provided with a plurality of recesses 30, 31 for attaching cover member 12.

As shown in FIG. 5, center stage portion 25 has a set of first slots 32 (at four locations) for attaching four first contacts 40, a set of second slots 33 (at four locations) for attaching four second contacts 50, and a set of third slots 34 (at four locations), all these slots extending parallel to each other in the anteroposterior direction. First slots 32 are situated in the rear half of center stage portion 25 while second slots 33 are situated in the front half of center stage portion 25, with the two sets of slots 32, 33 arrayed extending in the anteroposterior direction with their axes aligned. The third slots 34 are situated to the right of the two sets of slots 32, 33 (the top of the page in FIG. 5), arrayed extending in the anteroposterior direction. To the rear of center stage portion 25 are provided a first space 35 and a second space 36 extending in the anteroposterior direction for mounting a first switch member 60 and a second switch member 70 on center stage portion 25.

Figure 6:
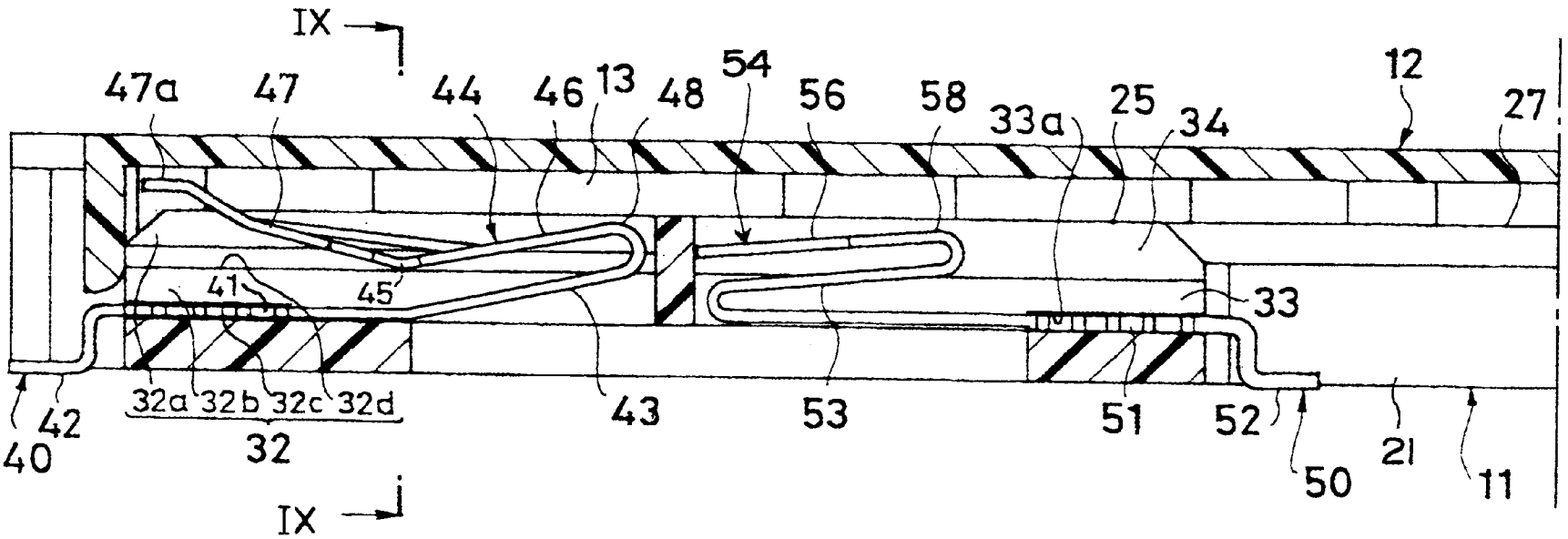
FIG. 6 is a sectional view of the card connector taken along line VI—VI in FIG. 5 (with the cover member in place)
Figure 9:
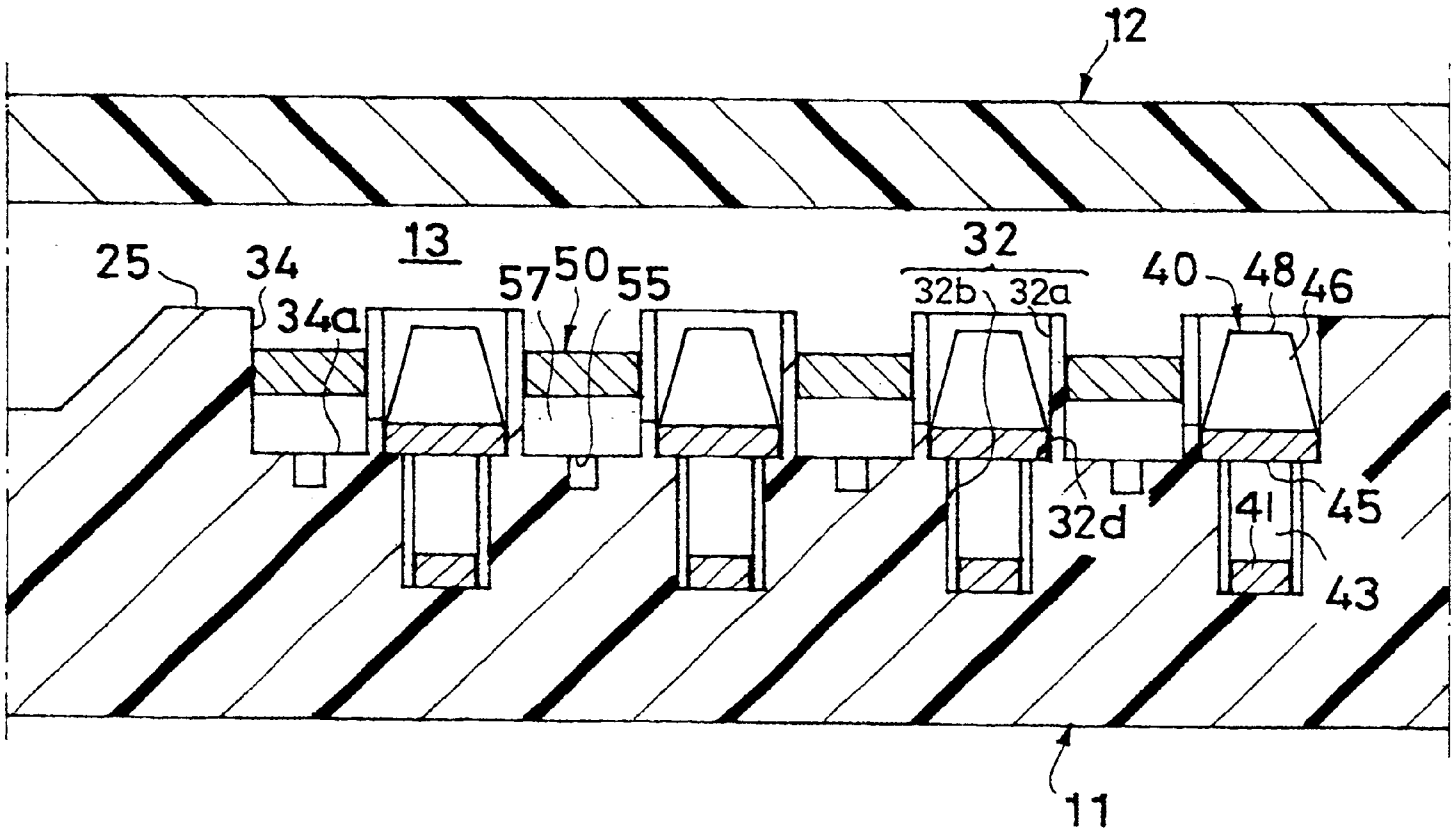
FIG. 9 is a sectional view of the card connector taken along line IX—IX in FIG. 6.

As shown in FIGS. 6 and 9, first slots 32 are composed of upper level slots 32*a* and lower level slots 32*b* narrower in width than upper level slots 32*a* and situated below upper level slots 32*a*. At the bottoms of lower level slots 32*b* (albeit in only a portion at the rear ends thereof) are provided first contact mounting slots 32*c* having greater widthwise extension than lower level slots 32*b*. As shown in FIG. 6, second slots 33 have the same depth as the lower level slots 32*b* of first slots 32 and are provided at the bottoms thereof (albeit in only a portion at the front ends thereof) with second contact mounting slots 33*a* having greater widthwise extension than second slots 33 (see FIG. 2). Third slots 34 have the same depth as the upper level slots 32*a* of first slots 32.

As shown in FIG. 6, each first contact 40 comprises a fastening portion 41 insertedly fastened within a first contact mounting slot 32*c*, a lead portion 42 curving rearward and downward from fastening portion 41 and extending towards the rear of bottom wall 21, a connecting portion 43 extending diagonally frontward and upward from fastening portion 41, and a "V" shaped arm portion 44 connected with this connecting portion 43. This "V" shaped arm portion 44 has a first arm portion 46 extending diagonally frontward and upward from a basal portion 45 and a second arm portion 47 extending diagonally rearward and upward from the basal portion 45. A contact portion 48 formed at the distal end of first arm portion 46 connects with the connecting portion 43 (second arm portion 47 is situated above fastening portion 41).

As shown in FIG. 9, the fastening portion 41 and the lower portion of connecting portion 43 of each first contact 40 are accommodated in a lower level slot 32*b*, and the upper portion of connecting portion 43 and the "V" shaped arm portion 44 are accommodated in an upper level slot 32*a*, respectively. The portion of first contact 40 above fastening portion 41 thereof is resiliently deformable, and basal portion 45 is narrower in width than upper level slot 32*a* and greater in width than lower level slot 32*b* so as to abut the floor 32*d* of upper level slot 32*a*, restricting downward displacement of the member. Contact portion 48 is situated below receiving space 13, and pressure engaging portion 47*a*, formed by substantially horizontal deflection of the distal end of second arm portion 47, is situated within receiving space 13.

Figure 7:
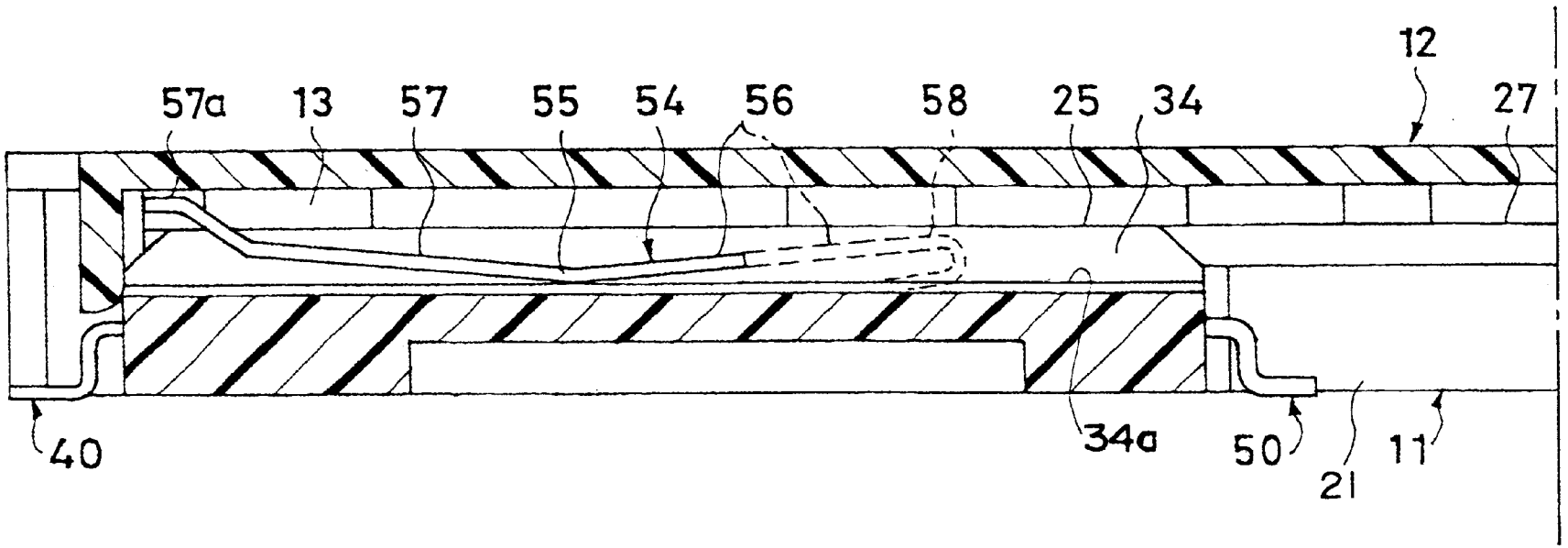
FIG. 7 is a sectional view of the card connector taken along line VII—VII in FIG. 5 (with the cover member in place)

As shown in FIGS. 6 and 7, each second contact 50 comprises a fastening portion 51 insertedly fastened within a second contact mounting slot 33*a*, a lead portion 52 curving frontward and downward from fastening portion 51 and extending towards the front of bottom wall 21, a connecting portion 53 extending rearward from fastening portion 51 and then folding back to extend diagonally frontward and upward, and a "V" shaped arm portion 54 connected with this connecting portion 53. This "V" shaped arm portion 54 has a first arm portion 56 extending diagonally frontward and upward from a basal portion 55 and a second arm portion 57 extending diagonally rearward and upward from the basal portion 55. A contact portion 58 formed at the distal end of first arm portion 56 is connected with the connecting portion 53 (first arm portion 56 is situated above fastening portion 51).

As shown in FIGS. 2 and 5, the first arm portion 56 of the "V" shaped arm portion 54 of each second contact 50 bends rightward from contact portion 58 towards basal portion 55 (bends towards the top of the page in FIG. 5). Thus, the fastening portion 51 and connecting portion 53 of second contacts 50 are accommodated in second slots 33, the first arm portion 56 thereof is accommodated straddling second slots 33 and third slots 34, and the basal portion 55 and second arm portion 57 thereof are accommodated in third slots 34, respectively. The portion of second contact 50 above fastening portion 51 thereof is resiliently deformable, and basal portion 55 abuts the floor 34*a* of third slot 34 restricting downward displacement. Contact portion 58 is situated below receiving space 13, and pressure engaging portion 57*a*, formed by substantially horizontal deflection of the distal end of second arm portion 57, is situated within receiving space 13.

In this way, the contact portions 58 and fastening portions 51 of second contacts 50 are situated forward of the contact portions 48 and fastening portions 41 of first contacts 40, and the first arm portions 56 of second contacts 50 deflect rightward so that the second arm portions 47 of first contacts 40 and the second arm portions 57 of second contacts 50 are mutually parallel and arrayed in alternating fashion in the sideways direction. Thus, the contact portions 48 of first contacts 40 and the contact portions 58 of second contacts 50 can be arranged in a row in the anteroposterior direction while arranging the pressure engaging portions 47*a*, 57*a* of the contacts 40, 50 in the sideways direction (see FIG. 5).

Figure 8:
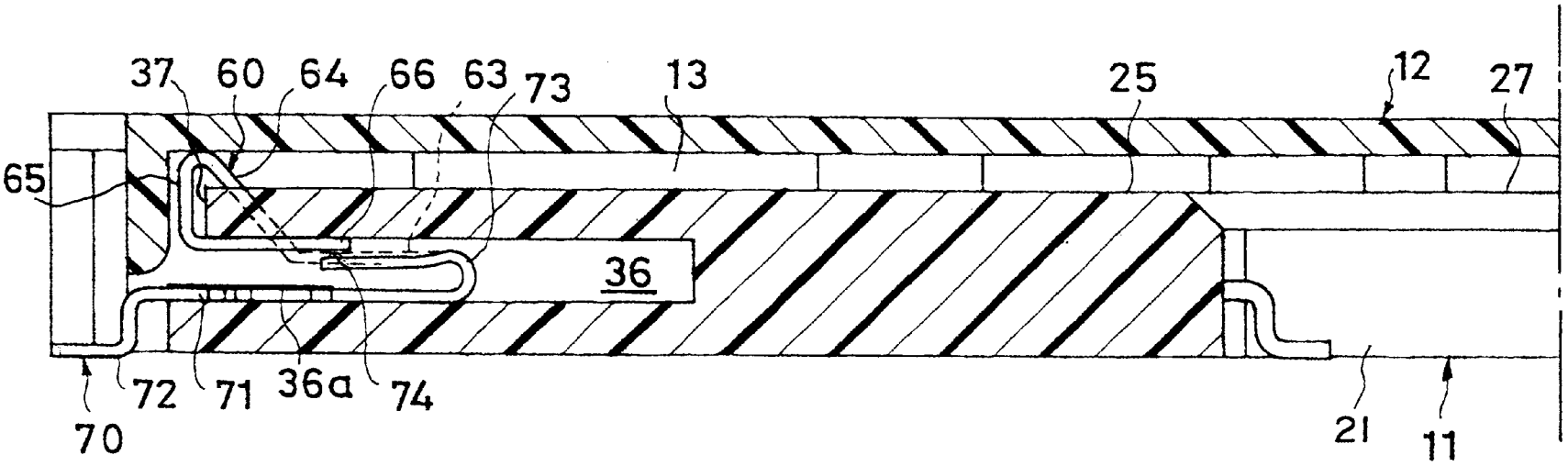
FIG. 8 is a sectional view of the card connector taken along line VIII—VIII in FIG. 5 (with the cover member in place)
Figure 10:
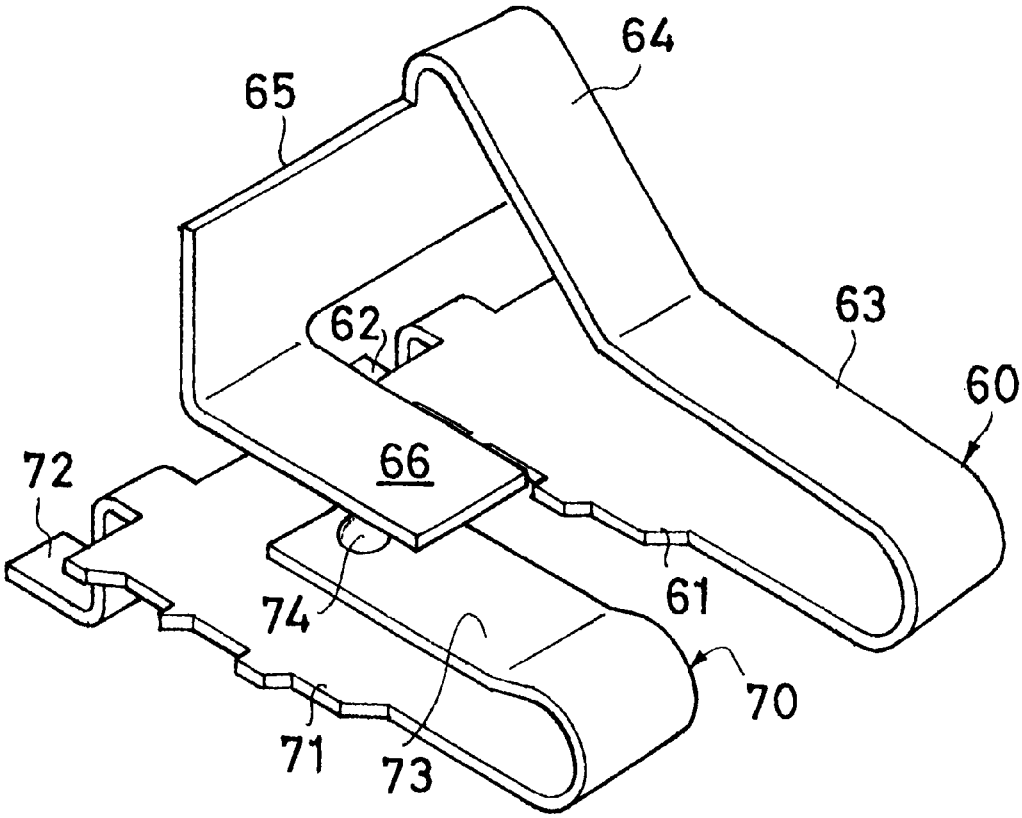
FIG. 10 is a perspective view showing first and second switch members.

As shown in FIGS. 5 and 8, a first switch member 60 straddles first space 35 and second space 36, and as shown in FIG. 10 (the chassis member 11 of housing 10 has been omitted in FIG. 10) comprises a fastening portion 61 insertedly fastened within a first switch member mounting slot 35*a* formed in the bottom of first space 35, a lead portion 62 bending downward from fastening portion 61 and extending towards the rear of bottom wall 21, a first arm portion 63 extending horizontally forward from fastening portion 61 and then bending back upward to extend horizontally rearward, a second arm portion 64 extending diagonally rearward and upward from the rear end of first arm portion 63, a third arm portion 65 extending downward from the top end of second arm portion 64 and extending rightward (towards second switch member 70), and a contact portion 66 extending horizontally forward from the bottom end of the rightward-extending portion of third arm portion 65. A recess 37 open at the top is provided at the rear of first space 35 and second space 36, and second arm portion 64 projects upward through this recess 37 so as to be situated within receiving space 13, while contact portion 66 is situated within second space 36.

As shown in FIGS. 5 and 8, a second switch member 70 is provided within a second space 36, and comprises a fastening portion 71 insertedly fastened within a second switch member mounting slot 36*a* formed in the bottom of second space 36, a lead portion 72 bending downward from fastening portion 71 and extending towards the rear of bottom wall 21, an arm portion 73 extending horizontally forward from fastening portion 71 and then bending back upward to extend horizontally rearward, and a contact portion 74 projecting convexly from the top face of arm portion 73. The contact portion 74 of second switch member 70 is situated below the contact portion 66 of first switch member 60.

As shown in FIG. 4, cover member 12 is formed on a flat panel and is provided at the left and right sides thereof with a plurality of arm portions 12*b* extending downwardly and having hooks (not shown) produced by inwardly bending their ends. When cover member 12 is arranged over chassis member 11 so as to cover it from above, the hooks of arm portions 12*b* are caught within recesses 30, 31 formed in the left and right side walls 23, 24 of chassis member 11, thereby detachably mounting cover member 12 onto chassis member 11.

In a card connector of the above design the lead portions 42, 52 of the two sets of contacts 40, 50 and the lead portions 62, 72 or the two switch members 60, 70 are surface mounted on the terminal pattern of a baseplate 6 shown in FIG. 1, and wires 7 (preferably FPC or FFC) are extended rearward from the rear portion of the baseplate 6.

As shown in FIGS. 1 to 3, case 100 comprises, on a planar stage 110, left/right side support members 111, 112 of inverted "L" cross section and extending in the anteroposterior direction, and left/right bottom face support members 113, 114 extending in the anteroposterior direction and having projecting portions 113*a*, 114*a* projecting upward at the front ends thereof The space defined by these members accommodates the connector element 5 so as to enable it to slide in the anteroposterior direction (i.e. the card 2 insert/eject direction). Specifically, the connector element 5 is arranged with the bottom face thereof resting on the top faces of the left/right bottom face support members 113, 114, with the side faces thereof supported by the inside faces of the left/right side support members 111, 112. Projecting portions 113*a*, 114*a* formed on the side support members 111, 112 are provided to prevent the connector element 5 from falling out from the front of the case 100.

As shown in FIGS. 1 and 3, slots 115, 116 extending in the anteroposterior direction are formed on the side faces of the left/right side support members 111, 112, and spring mounting portions 121, 122 provided on both sides of a connector element mounting member 120 extending in the sideways direction are mounted within these two slots 115, 116 so as to be slidable in the anteroposterior direction. As shown in FIG. 1, connector element mounting member 120 is provided with frontwardly projecting left/right joining tabs 123, 124; as shown in FIG. 4, these joining tabs 123, 124 couple with left/right joining recesses 15, 16 formed in the housing 10 of connector element 5 in order to join the two members 5, 120 together.

The spring mounting portions 121, 122 provided on either side of connector element mounting member 120 are coupled respectively with spring mounting portions 117, 118 provided on the side faces of left/right side support members 111, 112 by means of springs (helical compression springs) SP1, SP2 arranged extending in the card 2 insert/eject direction (anteroposterior direction), whereby the connector element 5 is slidable in the anteroposterior direction and is normally urged in the frontward direction (i.e., the card 2 eject direction). As shown in FIG. 1, a rearward extending tabular locked portion 125 is provided to the connector element mounting member 120, this locked portion 125 having a tapered configuration that flares outward going from back to front, and having at the front of the left edge 126 thereof a projection 127 projecting leftward.

A divider panel 130 and a rear wall 170, both extending in the sideways direction, are provided to the rear of the connector element mounting member 120, and a floor member 180 situated parallel to stage 110 is provided situated between divider panel 130 and rear wall 170, above stage 110 (accordingly, a gap is present between the top face of stage 110 and the bottom face of floor member 180, and the wires 7 pass through this gap from front to back). The space defined by the divider panel 130, rear wall 170, and floor member 180 accommodates a solenoid 140, a piston 141 that is magnetically attracted leftward when electrical current is passed through solenoid 140, a locking member 143 attached to the right end of piston 141, and a spring 142, situated between solenoid 140 and locking member 143, for normally urging locking member 143 rightward. The locking member 143 is of box configuration open at its top and right side; the front panel 144 thereof is arranged parallel with divider panel 130.

Since the locking member 143 is urged rightward by the spring 142, in the absence of electrical current flow through solenoid 140 it is positioned at its rightward position (rightward movement of the locking member 143 by spring 142 is checked by a stopper 146), and when electrical current is passed through solenoid 140 the piston 141 is attracted leftward, moving the locking member to its leftward position in opposition to the urging force of spring 142. ON/OFF control of solenoid 140 (i.e., control of electrical current to solenoid 140) is accomplished by operation of a switch 147 provided on the exterior of case 100. When switch 147 is not activated, no current flows to the solenoid 140 and the locking member 143 is positioned at the rightward position, and when switch 147 is activated, current flows to the solenoid 140 so that the locking member 143 moves to the leftward position.

As shown in FIG. 1, divider panel 130 and the front panel 144 of locking member 143 are respectively provided with slots 131, 145 extending in the sideways direction. These two slots 131, 145 each have height and sideways extension greater than the sideways extension of the locked portion 125 provided to the connector element mounting member 120. The slot 131 in divider panel 130 is situated at a location such that when the connector element mounting member 120 slides rearward the locked portion 125 can pass therethrough with no contact, and the slot 145 in locking member 143 is situated at a location such that when the solenoid 140 is ON and locking member 143 is positioned at the leftward position, locked portion 125 can pass therethrough with no contact (see FIG. 11A). With solenoid 140 OFF and locking member 143 positioned at the rightward position, slot 145 is shifted to the right of its position with solenoid 140 ON, and the left edge 145*a* thereof is positioned rightward of the left edge 131*a* of the slot 131 in divider panel 130 (see FIG. 11B).

In this way, with the left edge 145*a* of slot 145 in and locking member 143 positioned to the right of the left edge 131*a* of the slot 131 in divider panel 130 (i.e., with solenoid 140 OFF), rearward sliding of the connector element mounting member 120 results in the left edge 126 of the locked portion 125 passing through the slot 131 in divider panel 130 and subsequently coming in abutment with the left edge 145*a* of slot 145 in locking member 143 (see FIG. 12A). Locking member 143 is pushed leftward in opposition to the urging force of spring 142 as the locked portion moves further rearward (see FIG. 12B), and once the projection 127 of locked portion 125 has passed through slot 145, the left edge 126 (projection 127) of locked portion 125 ceases to be in abutment with the left edge 145*a* of slot 145, whereby the locking member 143 returns to its original position, i.e., the rightward position, under the urging force of the spring 142. In this way the locked portion 125 becomes locked (detained) by the locking member 143 (see FIG. 12C).

Figure 12A:
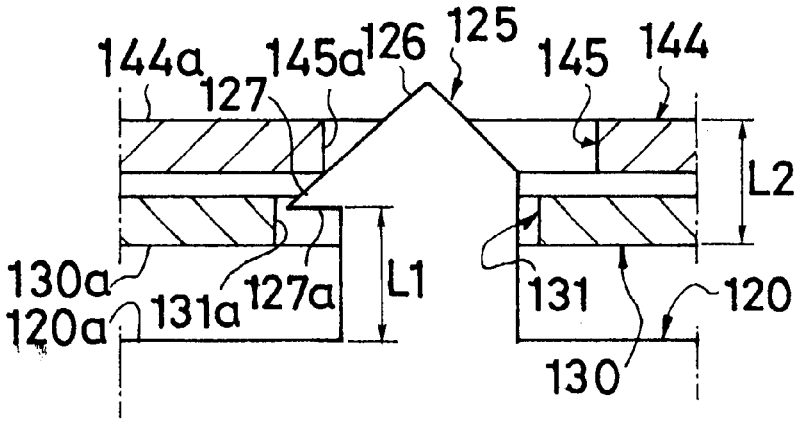
FIGS. 12A to 12C are diagrams showing the locked portion detained by the locking member, with FIG. 12A showing the left edge of the locked portion abutting the left edge of the locking member slot, FIG. 12B showing the locked portion having passed rearward of the locking member slot and FIG. 12C showing the locked portion detained by the locking portion, respectively.
Figure 12B:
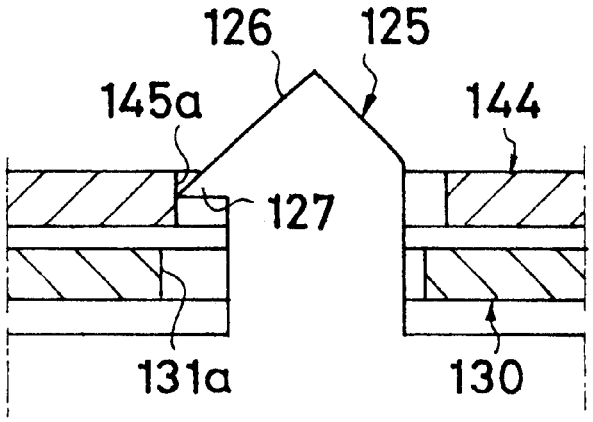
Figure 12C:
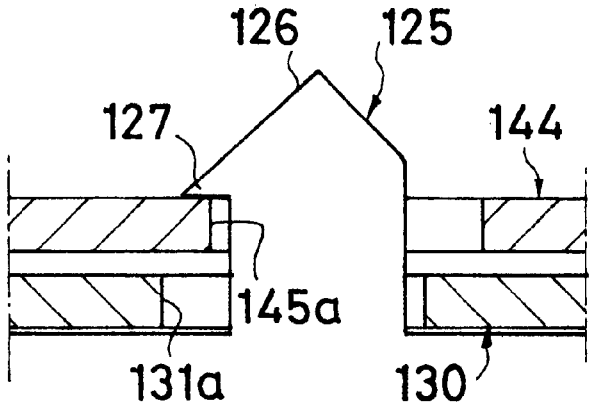

The distance L1 from the front face 127*a* of projection 127 to the rear face 120*a* of connector element mounting member 120 shown in FIG. 12A is designed to be somewhat greater than the distance L2 from the front face 130*a* of divider panel 130 to the rear face 144*a* of the front panel 144 of locking member 143, so with the locked portion 125 detained by the locking member 143, the rear face 120*a* of the connector element mounting member 120 is substantially in abutment with the front face 130*a* of divider panel 130.

As shown in FIG. 1, the connector element mounting member 120 is provided with a rearward projecting projection 128, and the divider panel 130 has formed therein an aperture 132 through which this projection 128 passes when the connector element mounting member 120 slides rearward. To the rear of this aperture 132 is provided a limit switch 160 which outputs a sensor signal when pushed by projection 128 passing through aperture 132 when connector element mounting member 120 slides rearward and comes into abutment with divider panel 130. The sensor signal from this limit switch 160 is input to a control device (not shown), and when presented with this sensor signal, the control device lights an indicator lamp (not shown). Thus, it may be confirmed visually that the connector element mounting member 120 is in abutment with divider panel 130, that is, that the locked portion 125 is locked by the locking member 143.

As shown in FIG. 1, the area to the rear of divider panel 130 has pivotally mounted therein a "L" shaped pivoting lever 151 pivoting on a pin 152. A control portion 151*a* located at a first end thereof projects out rightwardly from case 100 through a slot 153 provided in the side face of the right side support member 112 and extending in the antero-posterior direction (see FIG. 3). The right end of a rod 154 extending in the sideways direction is attached to a second end of this pivoting lever 151, and the left end of this rod 154 is coupled with the locking member 143. Thus, rearward operation of the control portion 151*a* of pivoting lever 151 causes rod 154 to move leftward, sliding the locking member 143 leftward in opposition to spring 142.

Figures 16A, 16B, 16C, 16D, 16E:
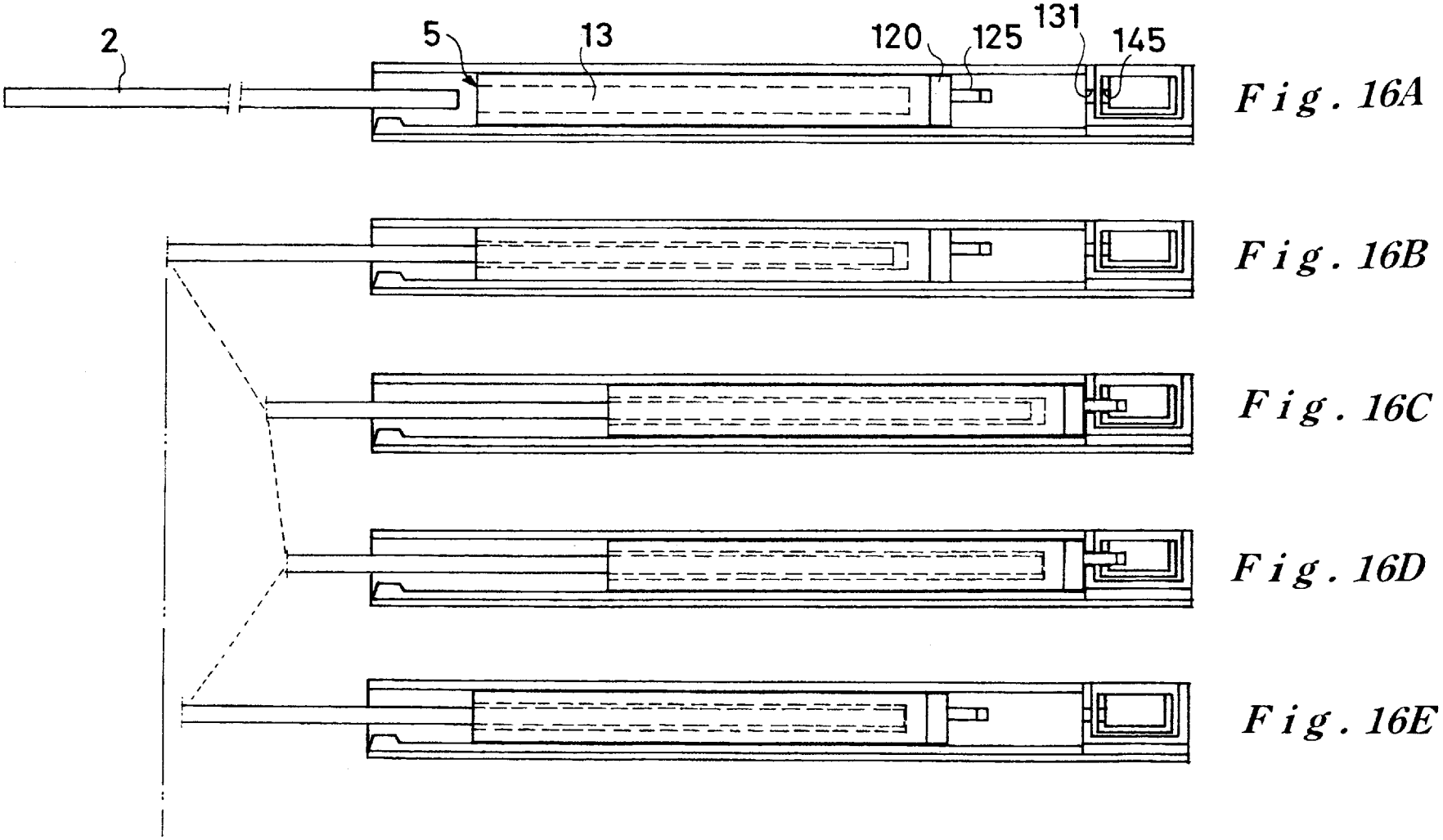
FIGS. 16A to 16E are diagrams illustrating in sequence the procedure of installing a card in the card connector up through subsequent ejection, FIG. 16A depicting the card just after insertion through the front of the case, FIG. 16B depicting the card abutting the pressure engaging portions of the first and second contacts, FIG. 16C depicting the locked portion just after being detained by the locking member, FIG. 16D depicting the pressure engaging portions of the two contacts in abutting contact with planar contacts on the card.

When inserting a card 2 in a card connector of this design, the card 2 is first inserted through the front of case 100 in the direction indicated by arrow A in FIG. 1 (see FIG. 16A). Card 2 is thereby guided smoothly into the receiving space 13 by the guide slots 28, 29 formed in the housing 10 of connector element 5.

Figure 13A:
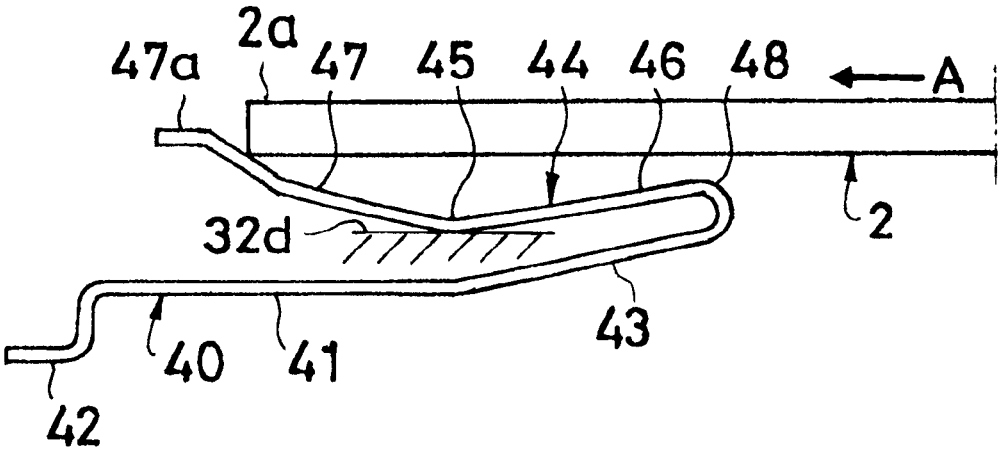
FIGS. 13A and 13B are simplified side views depicting resilient deformation of a first contact occurring with card insertion, FIG. 13A being a diagram showing the card distal edge abutting the pressure engaging portion of the first contact and FIG. 13B being a diagram showing resilient deformation of the first contact with the contact portion thereof in abutting contact with a planar contact on the card.
Figure 14A:
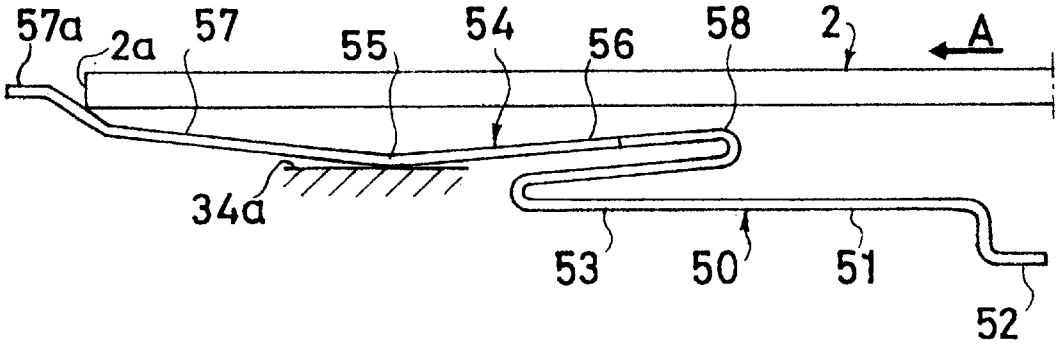
FIGS. 14A and 14B are simplified side views depicting resilient deformation of a second contact occurring with card insertion, FIG. 14A being a diagram showing the card distal edge abutting the pressure engaging portion of the second contact and FIG. 14B being a diagram showing resilient deformation of the second contact with the contact portion thereof in abutting contact with a planar contact on the card.

Once card 2 has been inserted into receiving space 13, the distal edge (rear edge) 2*a* of card 2 comes into abutment with the pressure engaging portions 47*a*, 57*a* of the first and second contacts 40, 50 (see FIGS. 13A, 14A, and 16B), whereby the connector element 5 slides rearward within case 100 until the connector element mounting member 120 comes into abutment with the divider panel 130 from the front. As described earlier, at this point the locked portion 125 of the connector element mounting member 120 pushes the locking member 143 to the right to pass through the slot 131 in the divider panel 130 and the slot 145 in the locking member 143, and is locked by means of the locking member 143 urged by the spring 142 (see FIG. 16C). At the same time, the projection 128 of connector element mounting member 120 passes through the aperture 132 in divider panel 130 and turns on the limit switch 160, causing the aforementioned indicator lamp to turn on.

Figure 13B:
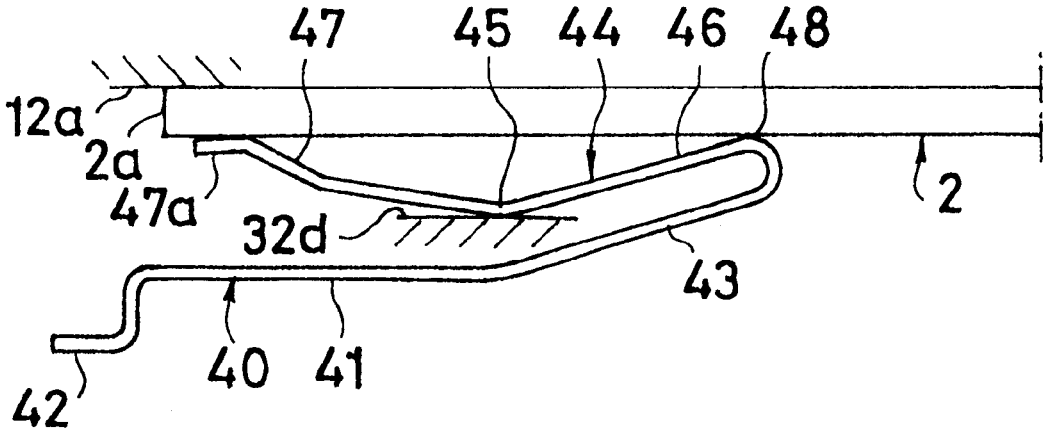
Figure 14B:
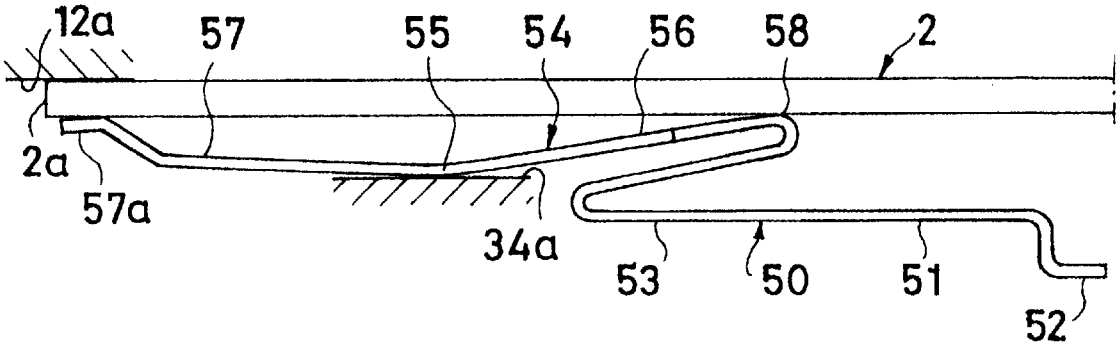

With the locked portion 125 locked by the locking member 143 in this way, the rear face of connector element mounting member 120 comes into abutment with the front face of divider panel 130, preventing the connector element mounting member 120 from sliding further rearward, and thus the distal edge (rear edge) 2*a* of card 2 forces downward (pushes) the pressure engaging portions 47*a*, 57*a* of the first and second contacts 40, 50. This causes the "V" shaped arm portions 44, 54 of the two sets of contacts 40, 50 to deflect about their basal portions 45, 55, pushing the contact portions 48, 58 upward, whereby the two sets of contact portions 48, 58 come into abutting contact with the planar contacts on card 2 (see FIGS. 13B and 14B, and see FIG. 16D). Even after being abutted by contact portions 48, 58, the planar contacts continue to move slightly rearward at the card 2 is pushed in, producing a wiping action between the two sets of contacts, so as to prevent faulty contact.

With the card 2 inserted into the receiving space 13, the first and second contacts 40, 50 are forced by card 2 to undergo resilient deformation, whereby the pressure engaging portions 47*a*, 57*a* force the distal edge 2*a* of card 2 upward against the bottom face 12*a* of the cover member 12 of housing 10. The distal edge 2*a* of card 2 is thereby pinched between the pressure engaging portions 47*a*, 57*a* of the two sets of contact 40, 50 on the one hand and the bottom face 12*a* of the cover member 12 on the other (see FIGS. 13B and 14B). In this way the card 2 is held securely within the receiving space 13.

Figure 15A:
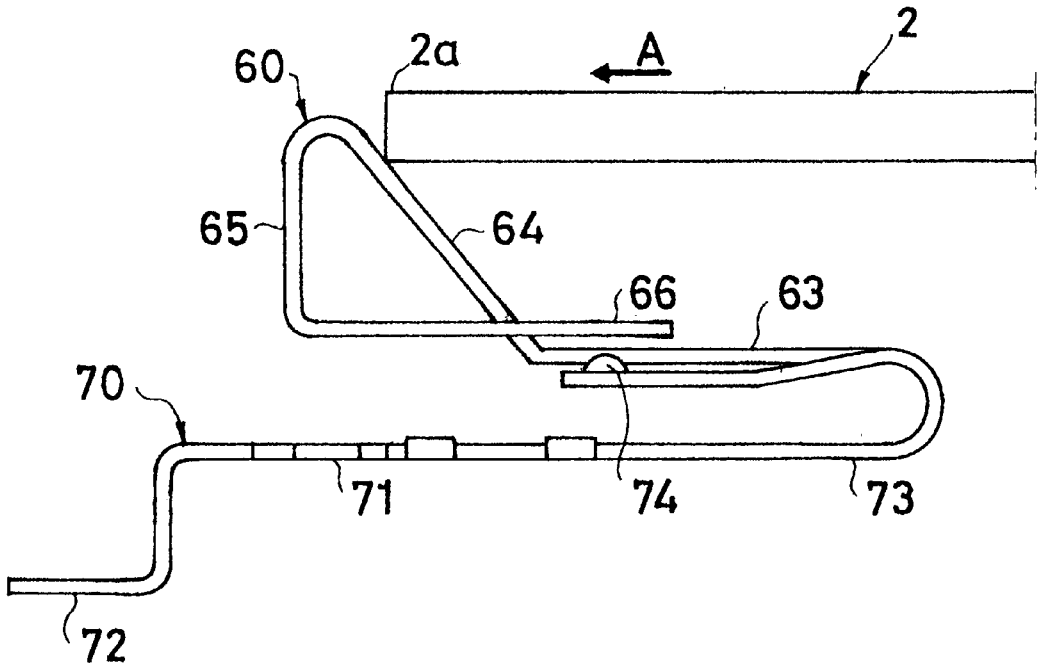
FIGS. 15A and 15B are simplified side views depicting resilient deformation of the first and second switch members occurring with card insertion, FIG. 15A being a diagram showing the card distal edge abutting the first switch member and FIG. 15B being a diagram showing resilient deformation of the first switch member such that the contact portion of the first switch member has come into abutting contact with the contact portion of the second switch member.
Figure 15B:
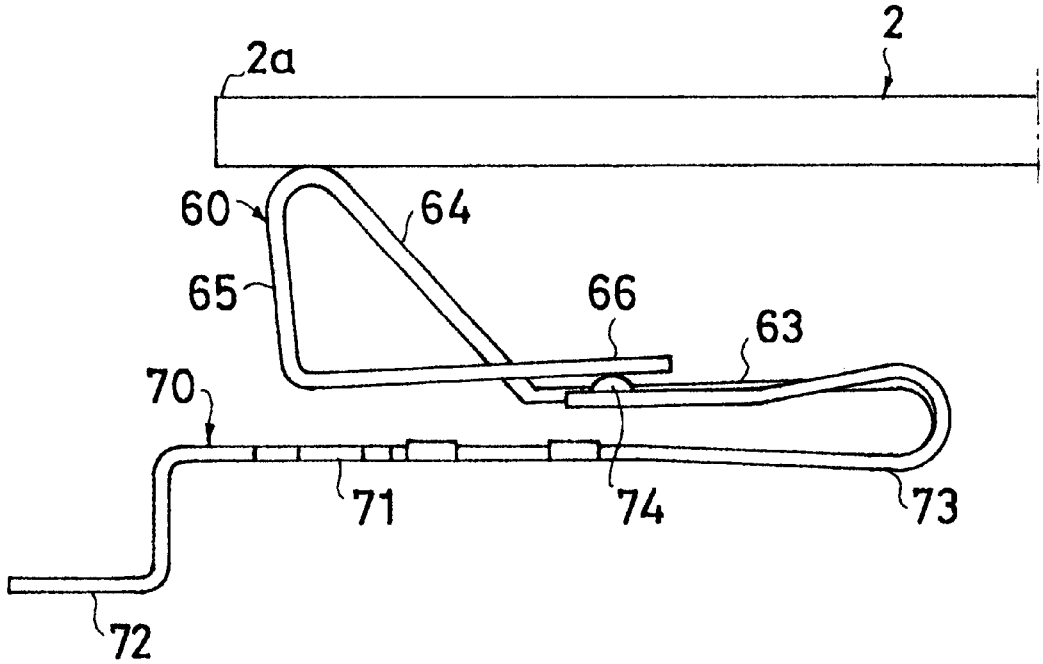

Further, with the card 2 inserted into the receiving space 13, the distal edge 2*a* of card 2 comes into abutment with the second arm portion 64 of the first switch member 60 (see FIG. 15A), forcing it downward. Thereupon the first switch 60 undergoes resilient deformation so that the contact portion 66 thereof moves downward and comes into abutting contact with the contact portion 74 of the second switch member 70 (see FIG. 15B). With the card 2 inserted in this way, the two switch members 60, 70 are electrically connected, and the power source turns on so that data can be transferred between the card 2 and the card connector 5 via the abutting contact portions of the planar contacts and the first and second contacts 40, 50.

Figure 11A:
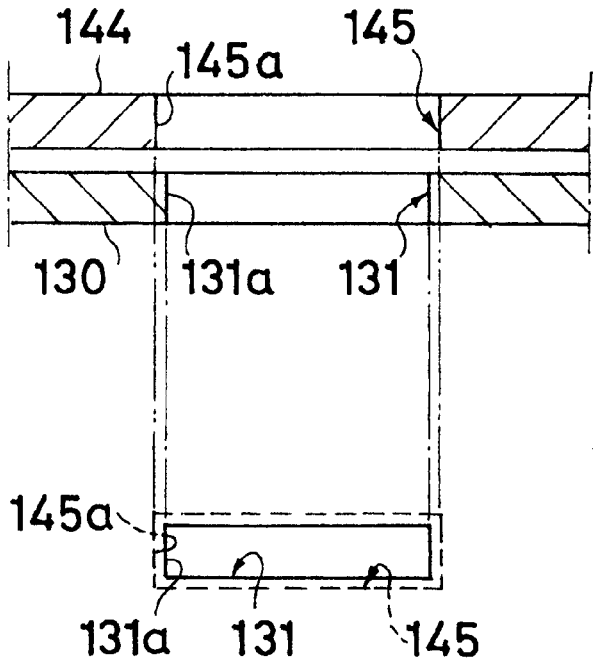
FIGS. 11A and 11B are diagrams illustrating the spatial relationship of the slot on the divider panel and the slot on the lock member, showing in vertical correspondence a sectional view of the divider panel and front panel taken in the horizontal plane along the slot axes, and the slots viewed from above, respectively, with FIG. 11A showing the solenoid on and the locking member positioned at the leftward position, and FIG. 11B showing the solenoid off and the locking member positioned at the rightward position.
Figure 11B:
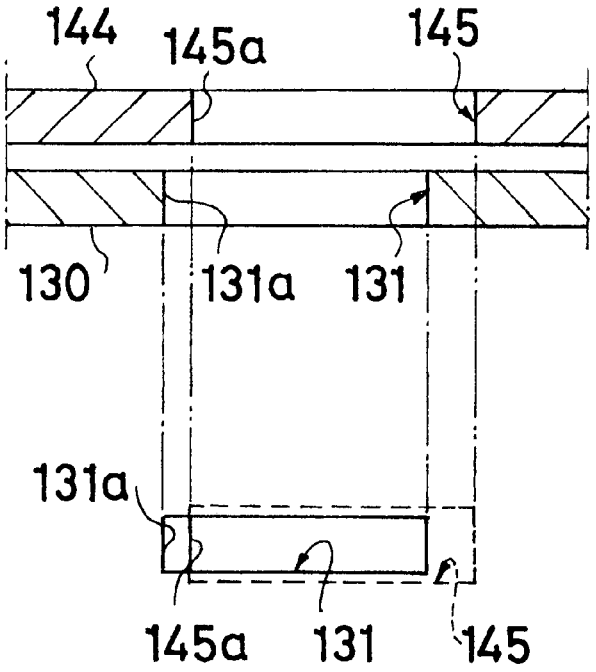

Once data transmission between the card 2 and the card connector has been completed and the card 2 is to be ejected, the aforementioned switch 147 is operated to turn on the solenoid 140 (this may be an instantaneous operation). The solenoid 140 thereby attracts the piston 141 leftward so that the locking member 143 slides to the left, causing the locking member 143 to slide leftward so that the slot 145 in the locking member 143 moves to a position where it no longer contacts the locked portion 125, allowing it to pass through, as shown in FIG. 11A. Since the connector element mounting member 120 is normally urged frontward by springs SP1, SP2, locking member 143 and locked portion 125 now disengage, and connector element mounting member 120 is pushed frontward by springs SP1, SP2. This causes the connector element 5, with card 2 still held within the receiving space 13, to slide frontwardly within the case 100 until the card 2 is ejected projecting out frontwardly from the case 100 (see FIG. 16E).

When the card 2 is removed from the card connector, the two sets of contacts 40, 50 and the two switch members 60, 70 are no longer forced to undergo resilient deformation and therefore return to their original positions prior to insertion of card 2. That is, the contact portions 48, 58 are situated below the receiving space 13, and the pressure engaging portions 47*a*, 57*a* are situated within the receiving space 13. The contact portions 66, 74 of the first and second switch members 60, 70 separate so that the power supply turns off.

In the event that the solenoid 140 should malfunction during card 2 ejection, making it impossible to electrically actuate (electromagnetically actuate) the locking member 143, the control portion 151*a* of the pivoting lever 151 is pressed rearward. This causes the pivoting lever 151 to pivot about the pin 152 so that the rod 154 pushes the locking member 143 leftward in opposition of the urging force of the spring 142, causing it to unlock so that the card 2 may be removed.

To recapitulate, in the card connector according to the first invention herein the connector element 5 is not fixed to the case 100 but is rather supported thereby so as enable sliding thereof in the card 2 insert/eject direction, and is furthermore normally urged in the card 2 eject direction by urging members, namely springs SP1, SP2, whereby the connector element 5 per se may be transported in the card 2 insert direction by the card 2 insertion force created during insertion of the card 2, and then locked in place at a predetermined position by locking means, namely locking member 143 and locked portion 125. Thus the card 2 may be accommodated fully inserted into the case 100, preventing the card 2 from inadvertently coming out during data transmission so as to assure successful data transmission. When ejecting the card 2, the lock is unlocked by unlocking means, namely the solenoid 140, and the connector element 5 per se is transported in the card 2 eject direction under the urging force of the urging member, preventing difficulty in ejecting the card 2 and avoiding impediments to the operation of ejecting the card 2.

Further, while in conventional arrangements that rely on an urging member to push out (or pull out) the card in order to eject it, the urging member must be able to produce urging force adequate to push out (or pull out) the card in opposition to the pinching force exerted on the card by the contacts, the urging member herein (springs SP1, SP2) need only produce force sufficient to move the connector element 5 in the card 2 eject direction, and as such can be made smaller in size, making the device more lightweight and compact overall. With this mechanism, card 2 ejection is accomplished by the recovery force of the urging member once the lock has been unlocked, and thus, in contrast to mechanisms in which the card 2 is forcibly pushed out in the eject direction, there is no risk of damage to the eject mechanism in the event that the card 2 should be mistakenly pushed in the insert direction during a card 2 eject operation. Higher safety is afforded thereby.

Figure 17:
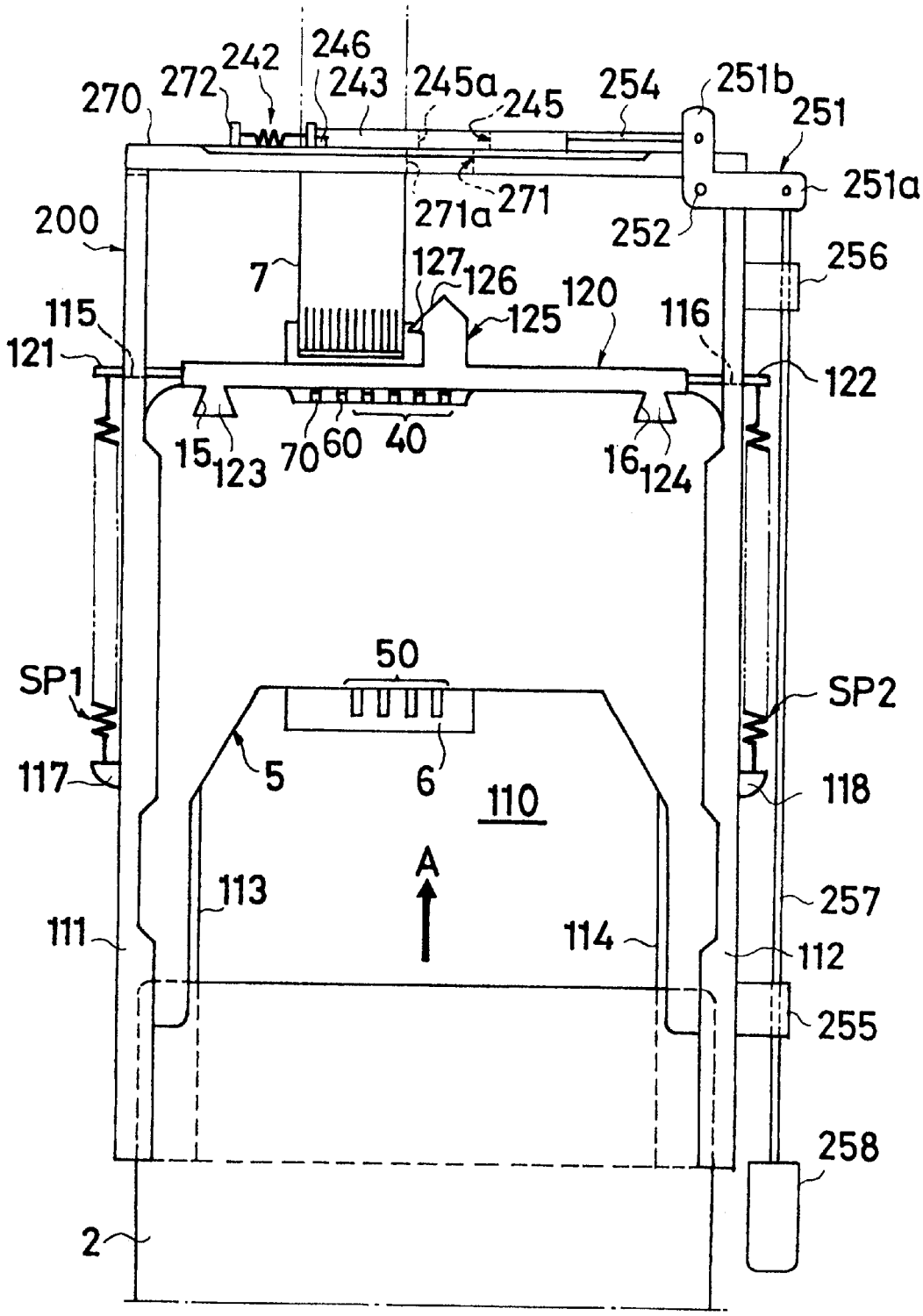
FIG. 17 is a plan view of a card connector pertaining to a second embodiment.

A second embodiment of the card connector pertaining to the first invention is now described. FIG. 17 is a plan view of the card connector pertaining to this embodiment. This card connector comprises the connector element 5 of the preceding first embodiment held in a case 200; this case 200 has a different mechanism for locking the connector element mounting member 120 than does the case 100 in the first embodiment. Identical symbols indicate elements similar to those of case 100, and these are not described further.

At the rear end of case 200 is provided a rear wall 270 extending sideways at a location corresponding to that of divider panel 130 in the case 100 described previously. Behind this rear wall 270 is provided a tabular locking member 243 that slides sideways along rear wall 270; this locking member 243 is normally urged rightward by a spring 242 provided between it and a spring support portion 272 projecting rearward from rear wall 270. The bottom edge of rear wall 270 is situated above baseplate 110 to form a gap, and wires 7 pass rearward through this gap from the baseplate 6 of connector element 5.

To the right of rear wall 270 is pivotally mounted an "L" shaped pivoting lever 251 pivoting on a pin 252. A first end 251*a* thereof projects out rightwardly from case beyond the right side support member 112. To this first end 251*a* of pivoting lever 251 is attached the rear end of a push rod 257 slidable in the anteroposterior direction and retained by push rod retaining members 255, 256 provided to the right side support member 112. The pivoting lever 251 can pivot about pin 252 when pushed rearward by a pusher portion 258 provided at the front end of this push rod 257.

The right end of a rod 254 extending in the sideways direction is attached to a second end 251*b* of the pivoting lever 251, and the left end of this rod 254 is attached to the right end of the locking member 243. Thus, when the pusher portion 258 of push rod 257 is not pushed rearward, rod 254 is positioned at the right and locking member 243 is positioned at the location to the right (rightward movement of the locking member 243 by spring 242 is checked by a stopper 246), but when the pusher portion 258 is pushed rearward, rod 254 moves leftward and locking member 243 slides leftward in opposition to spring 242 to position it at the location to the left.

Rear wall 270 and locking member 243 are respectively provided with slots 271, 245 extending in the sideways direction; these two slots 271, 245 have a relationship similar to that of slots 131, 145 in the first embodiment. Specifically, these two slots 271, 245 each have height and sideways extension greater than the sideways extension of the locked portion 125 provided to the connector element mounting member 120. The slot 271 in rear wall 270 is positioned such that when the connector element mounting member 120 slides rearward the locked portion 125 can pass therethrough with no contact, and the slot 245 in locking member 243 is positioned at a location such that when the pusher portion 258 of piston rod 257 is being operated to push rearward so that locking member 243 is positioned at the leftward position, the locked portion 125 can pass therethrough with no contact. When the pusher portion 258 is not being operated to push rearward, so that locking member 243 is positioned at the rightward position, slot 245 is positioned more to the right than is the case when the pusher portion 258 is being operated to push, and the left edge 245*a* thereof is positioned at a location to the right of the left edge 271*a* of the slot 271 in the rear wall 270 (similar to the relationship depicted in FIG. 11).

With the left edge 245*a* of slot 245 of locking member 243 positioned to the right of the left edge 271*a* of the slot 271 in the rear wall 270 (i.e., when the pusher portion 258 is not being operated to push rearward), rearward sliding of the connector element mounting member 120 results in the left edge 126 of the locked portion 125 passing through the slot 271 in rear wall 270 and subsequently coming in abutment with the left edge 245*a* of slot 245 in locking member 243. Locking member 243 is pushed leftward in opposition to the urging force of spring 242 as the locked portion moves further rearward, and once the projection 127 of locked portion 125 has passed through slot 271, the left edge 126 (projection 127) of locked portion 125 ceases to be in abutment with the left edge 245*a* of slot 245, whereupon the locking member 243 returns to its original position, i.e., the rightward position, under the urging force of the spring 242. In this way the locked portion 125 becomes locked (detained) by the locking member 243 (similar to the relationship depicted in FIG. 12).

Operation of the various elements during insertion of a card 2 into a card connector of this design is analogous to that in the first embodiment. To eject card 2, the pusher portion 258 of piston rod 257 is operated to push rearward (this may be instantaneous). As a result, the rod 254 moves leftward, the locking member 243 slides to the left, the locking member 243 and locked portion 125 disengage, and connector element mounting member 120 is drawn frontward by springs SP1, SP2. This causes the connector element 5, with the card 2 still held within the receiving space 13, to slide frontwardly within the case 200 until the card 2 is ejected projecting out frontwardly from the case 200. The working effects of the card connector pertaining to this second embodiment are analogous to those of the first embodiment.

A third embodiment of the card connector pertaining to the first invention is now described. FIGS. 18 to 21 are plan views of the card connector pertaining to this embodiment, FIG. 18 being a plan view of this card connector and FIG. 19 being a bottom view of this card connector. The connector element of this third embodiment employs a housing with a somewhat different configuration, but the internal construction thereof is similar to that in the first and second embodiments; identical symbols indicate elements similar to those of connector element 5, and these are not described further. While the card connector is covered from above by a cover member, for convenience the cover is omitted in the drawings.

Figure 18:
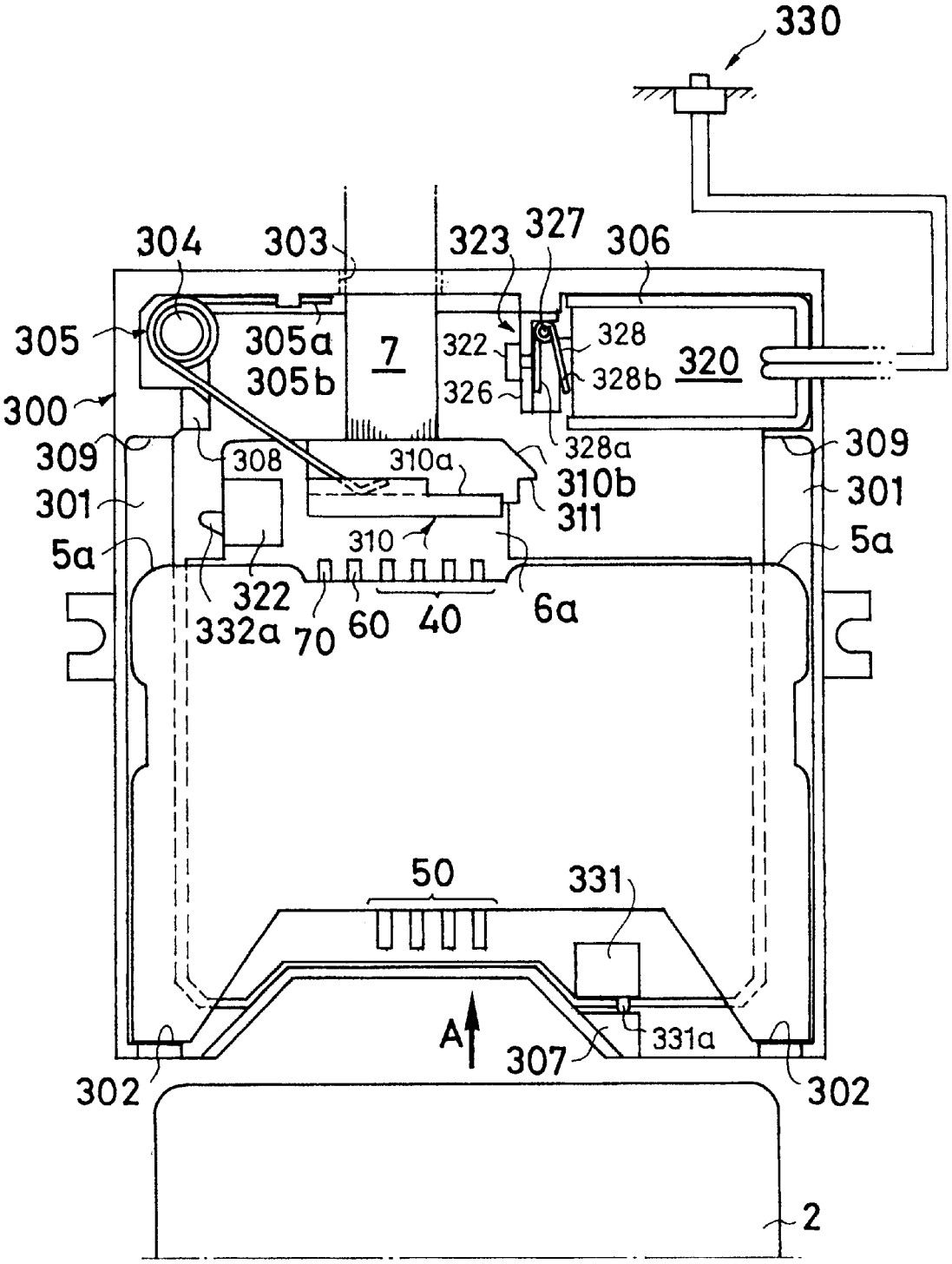
FIG. 18 is a plan view of a card connector pertaining to a third embodiment.
Figure 19:
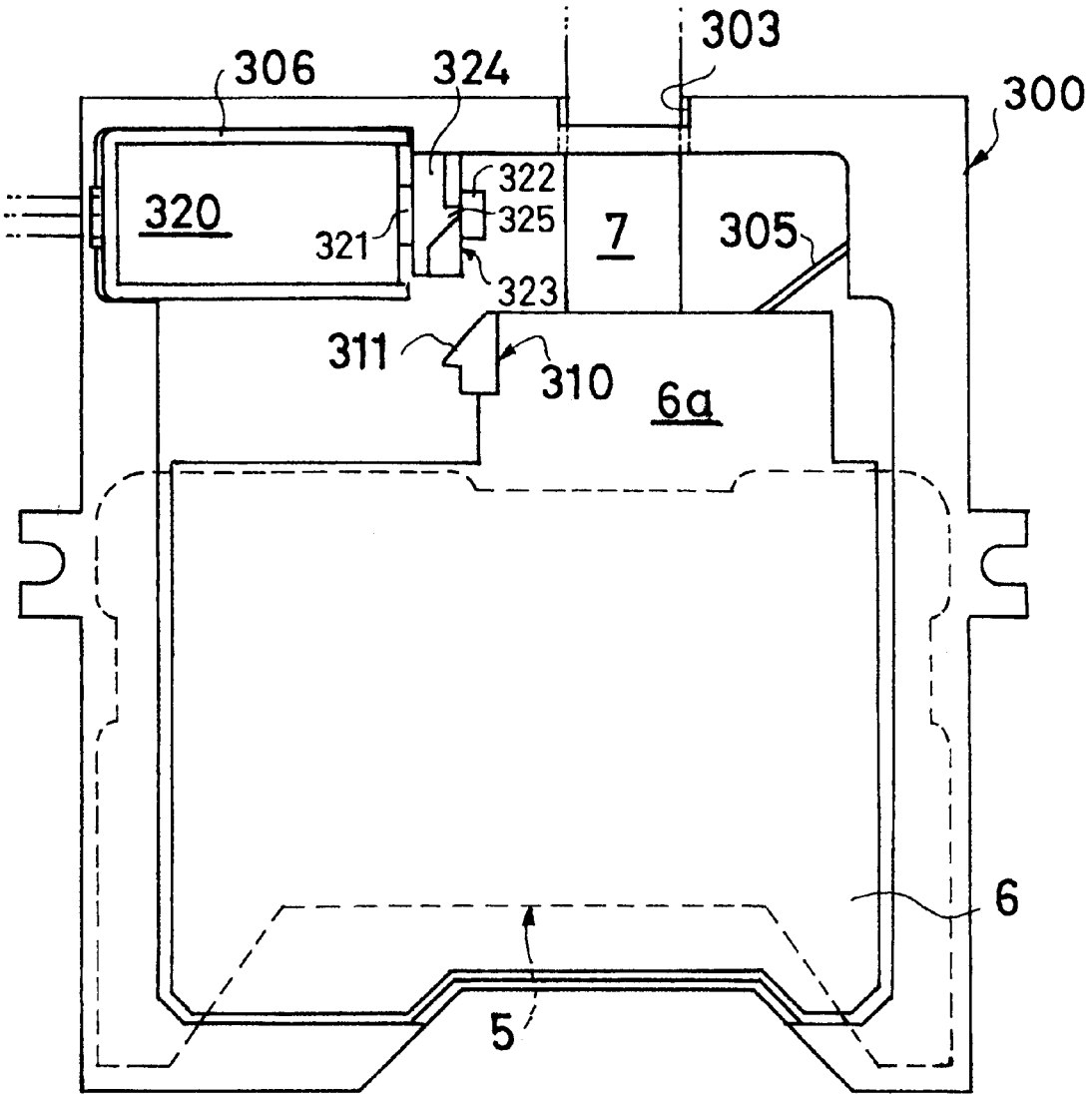
FIG. 19 is a bottom view of the card connector pertaining to the third embodiment.

The case 300 of the card connector of this third embodiment has an internal space of frame configuration as depicted in FIGS. 18 and 19, with connector element support members 301, 301 provided at the left/right sides for supporting the connector element 5 so as to enable it to slide in the anteroposterior direction (card 2 insert/eject direction). Stoppers 302, 302 are situated in front of these connector element support members 301, 301 in order to prevent the connector element 5 from falling out of the case 300.

A baseplate 6 (this baseplate is different in configuration than baseplate 6 in the preceding embodiments but is assigned the same symbol) is provided at the bottom face of the connector element 5, and is capable of movement in the anteroposterior direction with the connector element 5. An extension portion 6*a* extending rearward is provided at the rear of baseplate 6, and an approximately "L" shaped angled member 310 having an upwardly projecting wall portion 310*a* is attached to the top face of this extension portion 6*a*. At the right edge of a tabular floor portion 310*b* of the angled member 310 is formed a projection 311 having a taper that flares outwardly going from the rear towards the front. This projection 311 is engageable with a projection 325 on locking member 323, described later. Wires 7 leading from the baseplate 6 extend rearward, and these wires 7 pass to the outside of the case 300 through wire vias 303 provided at the rear of the case 300.

As shown in FIG. 18, case 300 is provided in the left rear portion thereof with an upwardly projecting spring mounting projection 304 of round cylindrical configuration. On this spring mounting projection 304 is mounted a helical spring 305, a first end 305*a* of which abuts the rear inside wall of case 300 from the front, and a second end 305*b* of which abuts the wall portion 310*a* of the angled member 310 from the rear. Thus, the connector element 5 is normally urged frontward (in the card 2 insert/eject direction) by means of helical spring 305.

A solenoid 320 is mounted in a solenoid mounting portion 306 provided in the right rear portion of case 300. An electromagnetically moveable piston 321 extends in the sideways direction from the solenoid 320 (see FIG. 19), with a locking member 323 mounted on the left end thereof. As shown in FIG. 19, a downwardly projecting projecting portion 324 is formed on the bottom face of this locking member 323, and a leftward-projecting (rightward in FIG. 19) projection 325 that has taper flaring outwardly going from the front towards the rear is formed on the left edge of projecting portion 324 (the right edge in FIG. 19).

As shown in FIG. 18, an upwardly extending wall portion 326 is provided on the locking member 323, and a spring mounting space is formed to the right of this wall portion 326. A helical torsion spring 328 is mounted on an upwardly projecting spring mounting projection 327 provided within this spring mounting space. A first end 328*a* thereof abuts the wall portion 326 from the right, and a second end 328*b* thereof abuts the solenoid 320 from the left. Accordingly, the locking member 323 is normally urged leftward from the solenoid 320.

Since the locking member 323 is urged leftward by the helical torsion spring 328 in this way, in the absence of current to the solenoid 320 it is positioned situated to the left (leftward movement of the locking member 323 by helical torsion spring 328 is checked by a stopper 322 provided at the left end of piston 321), and when electrical current is delivered to solenoid 320 the piston 321 is magnetically attracted rightward, moving the locking member to its rightward position in opposition to the urging force of helical torsion spring 328. ON/OFF control of solenoid 320 (i.e., control of electrical current to solenoid 320) is accomplished by means of a switch 330 provided on the exterior of case 300. When switch 330 is not activated, no current is delivered to the solenoid 320 so the locking member 323 is positioned at the leftward position, and when switch 330 is activated, current is delivered to the solenoid 320 so that the locking member 323 moves to the rightward position.

Figure 20A:
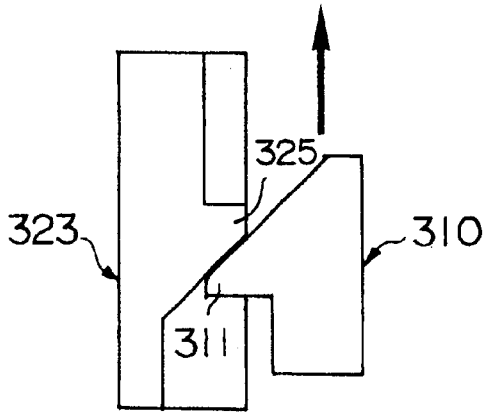
FIGS. 20A to 20C are diagrams illustrating the locked portion detained by the locking member in the third embodiment, FIG. 20A depicting the locked portion projection abutting the locking member projection from the front, FIG. 20B depicting the locked portion projection moving rearward while forcing the locking member projection sideways, and FIG. 20C depicting the locked portion detained by the locking member, respectively.
Figure 20B:
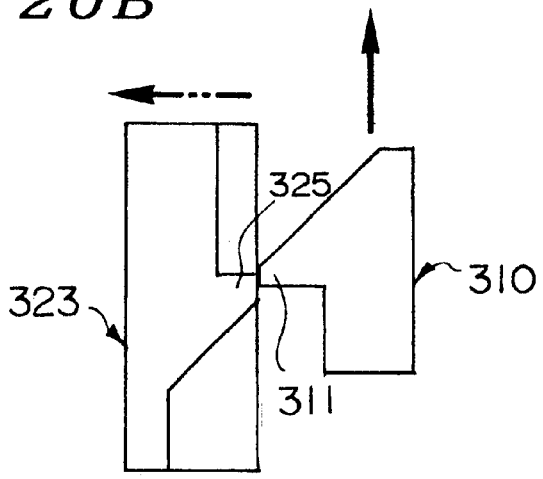
Figure 20C:
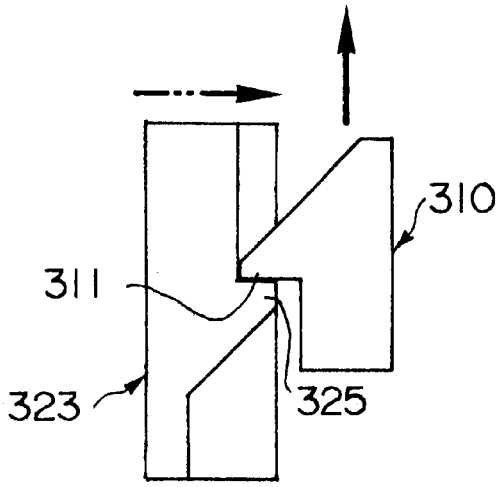
Figure 21:
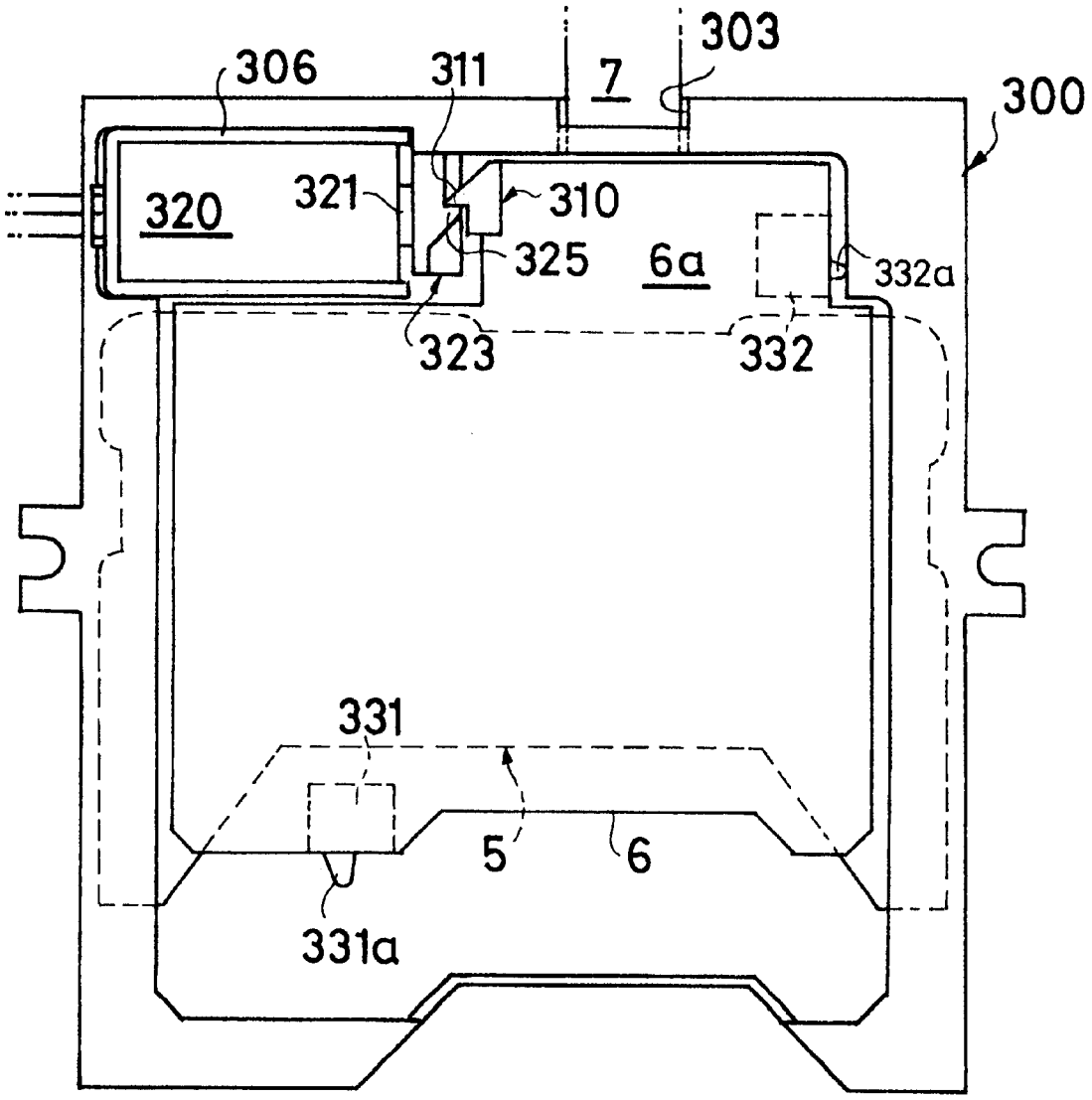
FIG. 21 is a bottom view of the card connector pertaining to the third embodiment showing the card connector locked with the angled member detained by the locking member.

In this way, with the locking member 323 positioned to the left (i.e., with the solenoid 320 OFF), rearward sliding of the connector element 5 results in the projection 311 of the angled portion 310, which moves rearward integrally with baseplate 6, so as to come into abutment with the projection 325 of locking member 323 from the front (see FIG. 20A; FIG. 20 shown here is a bottom view). The projection 311 of the angled portion 310 pushes aside to the right (leftward in FIG. 20) the projection 325 of locking member 323 in opposition to the urging force of the helical torsion spring 328 as it moves further rearward (see FIG. 20B), and once the projection 311 of the angled portion 310 has passed the location of the projection 325 of locking member 323, the projection 311 of the angled portion 310 and the projection 325 of locking member 323 cease to be in abutment, whereupon the locking member 323 returns to its original position, i.e., the leftward position (rightward in FIG. 20), under the urging force of the helical torsion spring 328. The angled portion 310 is thereby detained by the locking member 323 (see FIG. 20C). FIG. 21 shows the angled portion 310 detained by the locking member 323 in this way so that the connector element 5 is locked in the rearward position (this is a bottom view).

As shown in FIG. 18, a first limit switch 331 arranged with a switch portion 331*a* extending frontward is provided at a location on the top face of baseplate 6 in the frontward portion thereof. A second limit switch 332 arranged with a switch portion 332*a* extending leftward is provided at a location on the top face of the extension portion 6*a* baseplate 6. With the connector element 5 positioned frontward under the urging of a helical torsion spring 305, the switch portion 331*a* abuts from the front an upwardly extending switching projection 307 provided at the front of the case 300, and is thereby pushed inward (rearward) (the state shown in FIG. 18), whereupon the first limit switch 331 outputs an ON signal; with the connector element 5 slid slightly rearward from this position, the switch portion 331*a* comes away from the switching projection 307 and moves to the neutral position, whereupon an OFF signal is output.

On the other hand, with the connector element 5 slid rearward so that the angled portion 310 is detained by the locking member 323 (the state shown in FIG. 21), a switch portion 332*a* comes into abutment from the front with an upwardly projecting switching projection 308 provided in the left rear portion of the case 300, and is thereby pushed inward (rightward) (the state shown in FIG. 21), whereupon the second limit switch 332 outputs an ON signal; with the connector element 5 slid slightly forward from this position, the switch portion 332*a* comes away from the switching projection 308 and moves to the neutral position, whereupon an OFF signal is output.

ON/OFF signals from these two limit switches 331, 332 are input to a control device (not shown); upon being presented with these sensor signals, the control unit lights an indicator lamp (not shown). Thus, it may be confirmed visually whether the connector element 5 is situated at the frontward position with no card 2 inserted into the connector element 5, or whether the connector element 5 is situated at the rearward position with the angled portion 310 detained by the locking member 323.

When inserting a card 2 into a card connector of this design, the card 2 is first inserted through the front of case 300 in the direction indicated by arrow A in FIG. 18. As in the first and second embodiments, the connector element 5, pushed by the distal edge of the card 2, slides rearward into the case 300 until the two rear corners 5*a*, 5*a* of connector element 5 shown in FIG. 18 come into abutment with stoppers 309, 309 provided to the case 300. At this point the projection 311 of angled portion 310 on baseplate 6 pushes away to the right the projection 325 of the locking member 323, and is then locked in the manner described earlier by the locking member 323 under the urging of the helical torsion spring 328. At the same time, the second limit switch 332 turns ON, and the aforementioned indicator lamp is lit to indicate that the card 2 is inserted.

To eject the card 2, the aforementioned switch 330 is operated to turn solenoid 320 (this may be instantaneous) ON. As a result, the solenoid 320 attracts the piston 321 rightward so that the locking member 323 sides to the right, and since the connector element 5 is normally urged frontward by the helical torsion spring 305, the projection 325 of the locking member 323 and the projection 311 of the angled portion 310 disengage, whereupon the connector element 5 is pushed frontward by the helical torsion spring 305. This causes the connector element 5, still holding the card 2, to slide frontwardly within the case 300 until the card 2 is ejected projecting out frontwardly from the case 300.

In the event that the solenoid 320 should malfunction during card 2 ejection, making it impossible to electrically actuate (electromagnetically actuate) the locking member 323, a forced ejection knob 329 projecting upwardly from the top of the wall portion 326 of the locking member 323 is grasped with the hand and moved to the right. This moves the locking member 323 to the right so that the projection 323 thereof is disengaged from projection 311, allowing the card 2 to be ejected even if the piston 321 is not operable due to malfunction of the solenoid 320. In order that the forced ejection knob 329 can be operated with the cover member attached to the card connector, the cover member must be provided with an aperture through which the forced ejection knob 329 can pass, and having dimensions sufficient to permit the needed stroke for forced ejection.

As with the card connectors pertaining to the first and second embodiments, in the card connector pertaining to this third embodiment the connector element 5 is not fixed to the case 300 but is rather supported thereby so as enable sliding thereof in the card 2 insert/eject direction, and is furthermore normally urged in the card 2 eject direction by an urging member, namely a helical torsion spring 305, whereby the connector element 5 per se may be pushed in the card 2 insert direction by the card 2 insertion force created during insertion of the card 2, and then held in place at the card service position by locking means, namely, an angled portion 310 and a locking member 323. Thus the card 2 may be accommodated fully inserted into the case 300, preventing the card 2 from inadvertently coming out during data transmission so as to assure successful data transmission. When ejecting the card 2, the lock is unlocked by unlocking means, namely a solenoid 320, and the connector element 5 per se moves in the card 2 eject direction under the urging force of the urging member, preventing difficulty in ejecting the card 2 and avoiding impediments to the operation of ejecting the card 2.

In the card connectors pertaining to the first and second embodiments, the sides of the case 100 (or case 200) are linked to the sides of the connector element 5 by means of springs SP1, SP2, and thus the urging members (springs SP1, SP2) can be situated outside the case 300, allowing the space within the case 100 to be made smaller. By interposing a helical torsion spring 305 between the case inner wall and the end of the connector element 5 proximate to the case 300 wall (i.e., the rear end of the connector element 5) when moving in the card 2 insert direction, as in the card connector pertaining to the third embodiment, the urging member (helical torsion spring 305) can be housed compactly within the case 300. Such a design is useful in cases where the urging means cannot be situated outside the case and must be situated inside the case.

Designs wherein the urging force urging the connector element 5 frontward is provided by springs SP1, SP2 of a given length, as in the card connectors pertaining to the first and second embodiments, pose the risk of producing rattling noise when the connector element 5, with no card 2 inserted therein, is situated at the frontward position, whereas a design wherein the urging force urging the connector element 5 frontward is provided by a helical torsion spring 305, as in the card connector pertaining to the third embodiment, has the advantage of being resistant to rattling noise with the connector element 5 situated at the frontward position, and of holding to a minimum noise, impaired performance, etc. due to vibration.

In the card connectors pertaining to the two preceding embodiments, the locked portion 125, namely, the connector element mounting member 120, can be fabricated of resin, but the locking member 143 must necessarily be fabricated of metal due to its configuration, which in certain instances may result in diminished durability due to the use of different materials for the two elements (one being fabricated of metal), whereas with the card connector pertaining to this third embodiment, both the angled portion 310 and the locking member 323 can be fabricated either of resin or metal, affording improved durability.

As with the card connectors in the preceding first and second embodiments, in the card connector in this third embodiment, ejection of the card 2 is accomplished by means of the recovery force of an urging member (helical torsion spring 305) subsequent to unlocking, and thus in contrast to mechanisms which forcibly push the card 2 in the eject direction, there is no risk of damage to the eject mechanism in the event that the card 2 should be mistakenly pushed in the insert direction during a card 2 eject operation. Higher safety is afforded thereby.

Figure 22:
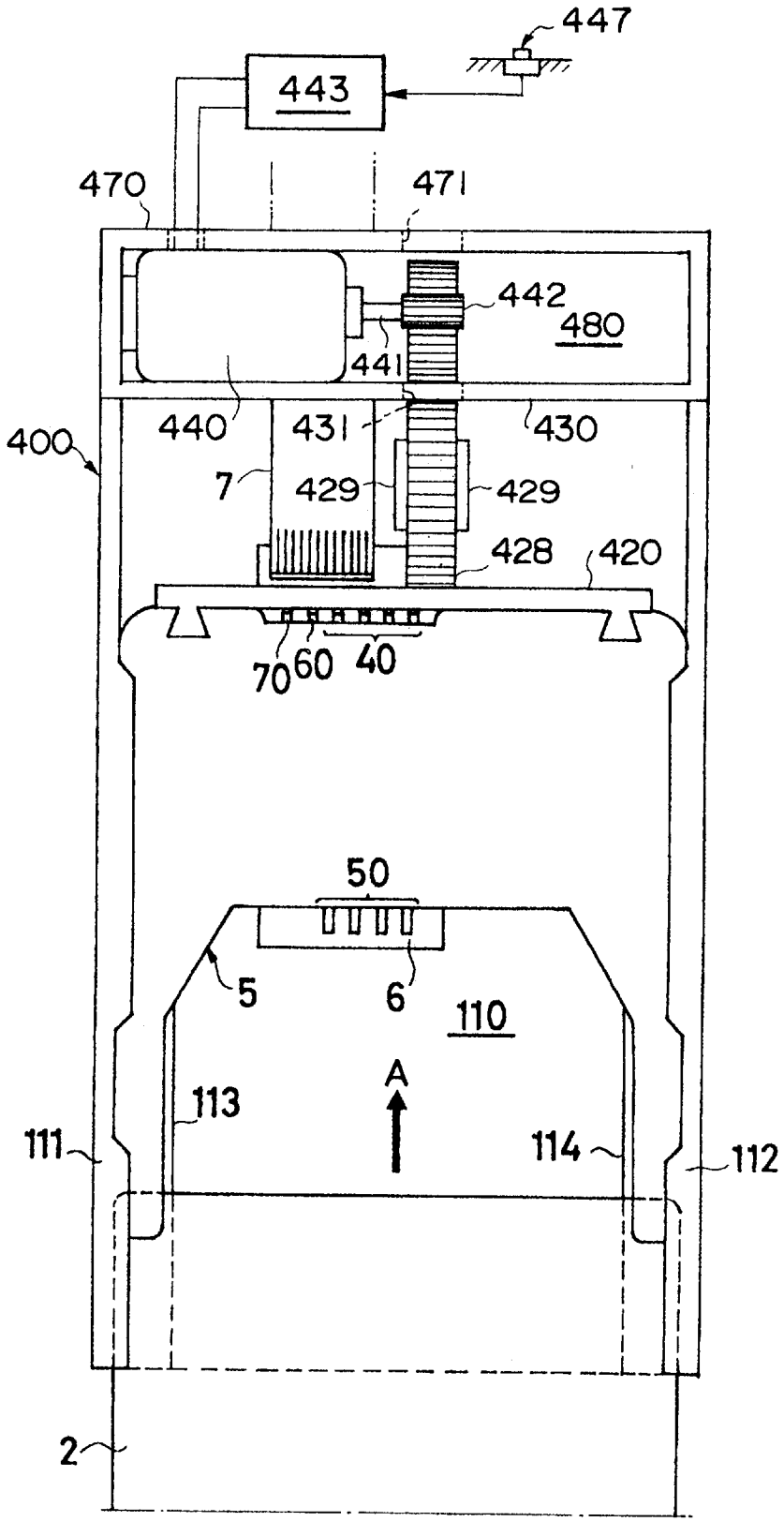
FIG. 22 is a plan view of a card connector pertaining to a fourth embodiment.

A fourth embodiment of the card connector pertaining to the invention is now described. FIG. 22 is a plan view of a card connector pertaining to this embodiment. This card connector has a design comprising the connector element 5 of the preceding first embodiment held in a case 400; however, this case 400 has a different mechanism for sliding the connector element 5 forward and backward than does the case 100 in the first embodiment. Identical symbols indicate elements similar to those of case 100, and these are not described further.

A connector element mounting member 420 similar to the connector element mounting member 120 in the first invention is attached to the rear of connector element 5, but unlike the first and second embodiments, a design wherein the connector element 5 is normally urged frontward by left/right springs SP1, SP2 is not employed, so the connector element mounting member 420 is not provided with spring mounting portions 121, 122 such as those provided to connector element mounting member 120, and is accordingly not provided with elements corresponding to the slots 115, 116 and spring mounting portions 117, 118 provided to left/right side support members 111, 112. Further, the connector element mounting member 420 is not provided with a locked portion 125 like that of the connector element mounting member 120 in the first embodiment, being provided instead with a rearward extending rack 428 with upward projecting teeth and guided by a guide portion 429 provided on baseplate 110. This rack 428 can move in the anteroposterior direction through an aperture 431 formed in a divider panel 430 extending sideways to the rear of connector element mounting member 420 and an aperture 471 formed in a rear wall 470 provided extending sideways to the rear of divider panel 430.

Between divider panel 430 and rear wall 470 is provided a floor member 480 situated above stage 110 and parallel to stage 110 (accordingly, a gap is present between the top face of stage 110 and the bottom face of floor member 480, and wires 7 pass through this gap from front to back). The space defined by the divider panel 430, rear wall 470, and floor member 480 accommodates an electric motor (dc servo motor) 440. To the shaft 441 of this electric motor 440 is attached a pinion 442 that meshes with the teeth of rack 428, and by controlling operation of the electric motor 440 by means of a control device 443 the rack 428 can be slid in the anteroposterior direction to transport the connector element 5 in the anteroposterior direction of the case 400.

When inserting a card 2 into a card connector of this design, the card 2 is first inserted through the front of case 400 in the direction indicated by arrow A in FIG. 22. Once card 2 has been inserted into receiving space 13, the distal edge 2*a* of card 2 comes into abutment with the pressure engaging portions 47*a*, 57*a* of first and second contacts 40, 50 (see FIGS. 13A and 14A), pushing these downward (pressure engagement). The "V" shaped arm portions 44, 54 of the two sets of second contacts 40, 50 thus deflect about their basal portions 45, 55, pushing the contact portions 48, 58 upward, whereby the contact portions 48, 58 thereof come into abutting contact with the planar contacts on card 2 (see FIGS. 13B and 14B).

With the card 2 inserted into the receiving space 13, the distal edge 2*a* of card 2 comes into abutment with the second arm portion 64 of the first switch member 60 (see FIG. 15A), forcing it downward. Thereupon the first switch 60 undergoes resilient deformation so that the contact portion 66 thereof moves downward and comes into abutting contact with the contact portion 74 of the second switch member 70 (see FIG. 15B). With the card 2 inserted into the receiving space 13 in this way, the two switch members 60, 70 are electrically connected, and the power source turns on so that data can be transferred between the card 2 and the card connector 5 via the abutting contact portions of the planar contacts and the first and second contacts 40, 50.

A signal indicating that the two switch members 60, 70 have been connected and the power source has turned on is input to the control device 443. Upon being presented with this signal input, the control device 443 operates the electric motor 440, moving the rack 428 rearward, whereby the connector element 5, still holding the card 2, slides rearward within case 400 so that card 2 is accommodated all the way into case 400. When the power source is on, the control device 443 controls the electric motor 440 so that the pinion 442 turns by an amount sufficient to move the connector element 5 to the predetermined rearward position.

Once data transmission between the card 2 and the card connector 5 has been completed and the card 2 is to be ejected, a switch 447 provided to the outside of case 400 is operated. A control signal is output to the control device 443 thereby, whereupon the control device 443 operates the electric motor 440 so that the rack 428 moves frontward. The connector element 5, with the card 2 still held therein, slides frontward within the case 400 so that the card 2 is ejected projecting out from the front of the case 400. When the switch 447 is operated, the control device 443 controls the electric motor 440 so that the pinion 442 turns by an amount sufficient to move the connector element 5 to the predetermined frontward position.

When the card 2 is removed from the card connector, the two sets of contacts 40, 50 and the two switch members 60, 70 are no longer forced to undergo resilient deformation and therefore return to their original positions prior to insertion of card 2. That is, the contact portions 48, 58 are situated below the receiving space 13, and the pressure engaging portions 47*a*, 57*a* are situated within the receiving space 13. The contact portions 66, 74 of the first and second switch members 60, 70 separate so that the power supply turns off.

In a card connector pertaining to this fourth embodiment, the connector element 5 is not fixed to the case 400 but is rather supported thereby so as to enable sliding thereof in the card 2 insert/eject direction, the connector element 5 being moveable in the card 2 insert/eject direction under the power of an electric motor 440, whereby the connector element 5 per se can be moved in the card 2 insertion direction in response to insertion of a card 2, and then held at a predetermined position. In this way, the card 2 is accommodated fully inserted into the case 400, thus preventing the card 2 from inadvertently coming out during data transmission. During card 2 ejection, the connector element 5, under the power of the electric motor 440, moves in the card 2 eject direction, preventing difficulty in ejecting the card 2 and avoiding impediments to the operation of ejecting the card 2.

In conventional arrangements that rely on roller members or the like driven by an electric motor to insert/eject the card, the electric motor must be able to produce force adequate to transport the card in opposition to the pinching force exerted on the card by the contacts. The electric motor 440 herein, however, need only produce force sufficient to move the connector element 5 in the card 2 eject direction, and as such can be made smaller in size, making the device more lightweight and compact overall. The electric motor can be made smaller in size, reducing its energy consumption and reducing operating costs.

While the preceding embodiments serve to illustrate the card connector of the invention, they are not to be construed as limiting the invention, within the scope of which various design modifications are possible. For example, while the first invention employs helical compression springs SP1, SP2 or a helical torsion spring 305 as means for normally urging the connector element 5 in the card 2 eject direction, other urging members, such as rubber or the like, could be used. In particular, helical extension springs could be used in place of helical compression springs as springs SP1, SP2 shown in the first and second embodiments pertaining to the first invention.

The construction of the means for locking the connector element 5 in the rearward position is not limited to one composed of the locking member 143 and locked portion 125 or angled member 310 projection 311 and locking member 323 projection 325 taught herein, it being possible to employ instead any alternative construction capable of holding the connector element 5 at a predetermined position once slid in the card 2 insert direction. The unlocking means may employ electric power or manual power as in the first through third embodiments set forth herein; means employing electric power are not limited to the solenoid taught herein and may consist instead of an electric motor of the like.

In the embodiments of the card connector of the invention set forth herein, the design of the connector element transport mechanism by which the connector element is positioned at the rearward position, under the power of an electric motor or positioned at the frontward position is not limited to the rack and pinion arrangement taught herein, is being possible to employ an alternative arrangement wherein the connector element is slid in the card insert/eject direction under the power of an electric motor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This application claims the priority of Japanese Patent Application No. 2000-118977 filed on Apr. 20, 2000 and No. 2000-213699 filed on Jul. 14, 2000, which are incorporated herein by reference.

What is claimed is:

1. A card connector comprising:

a connector element for removably holding a card containing stored data so as to allow data to be transmitted to and from this card; and a case for supporting said connector element so as to be slidable in said card insert/eject direction; wherein said card is inserted into or removed from said connector element with said connector element situated at a card insert/eject position to which said connector element has slid from said case in the eject direction; and data transmission is carried out with said card received and held by said connector element situated at card service position to which said connector element has slid into said case in the insert direction.

2. The card connector according to claim 1 further comprising:

an urging member for normally urging said connector element to said case in the direction of said card ejection; locking means for locking said connector element at said card service position once said connector element has been slid in the insert direction to said card service position; and unlocking means for unlocking said locking produced by said locking means.

3. The card connector according to claim 2 wherein said urging member comprises helical compression or extension springs arranged extending in said card insert/eject direction and linking the side portions of said case with the side portions of said connector element.

4. The card connector according to claim 2 wherein said urging member comprises a helical torsion spring arranged extending between the inner wall of said case and the end of said connector element proximate to the wall of said case when moving in said card insert direction.

5. The card connector according to claim 2 wherein said locking means effects holding at said predetermined position by means of a detained member provided to said connector element being detained by a detaining member provided to said case; and said unlocking means releases detainment by moving said detaining member in the release direction using electric power.

6. The card connector according to claim 2 wherein said locking means effects holding at said predetermined position by means of a detained member provided to said connector element being detained by a detaining member provided to said case; and said unlocking means releases detainment by moving said detaining member in the release direction by means of a manual operation.

7. The card connector according to claim 1 further comprising:

an electric motor; and a connector element transport mechanism driven by said electric motor for sliding said connector element between said card insert/eject position and said card service position.

8. The card connector according to claim 3 wherein said locking means effects holding at said predetermined position by means of a detained member provided to said connector element being detained by a detaining member provided to said case; and said unlocking means releases detainment by moving said detaining member in the release direction using electric power.

9. The card connector according to claim 4 wherein said locking means effects holding at said predetermined position by means of a detained member provided to said connector element being detained by a detaining member provided to said case; and said unlocking means releases detainment by moving said detaining member in the release direction using electric power.

10. The card connector according to claim 3 wherein said locking means effects holding at said predetermined position by means of a detained member provided to said connector element being detained by a detaining member provided to said case; and said unlocking means releases detainment by moving said detaining member in the release direction by means of a manual operation.

11. The card connector according to claim 4 wherein said locking means effects holding at said predetermined position by means of a detained member provided to said connector element being detained by a detaining member provided to said case; and said unlocking means releases detainment by moving said detaining member in the release direction by means of a manual operation.

* * * * *